US011521546B2

(12) United States Patent
Park et al.

(10) Patent No.: US 11,521,546 B2
(45) Date of Patent: Dec. 6, 2022

(54) DISPLAY DEVICE

(71) Applicant: Samsung Display Co., Ltd., Yongin-Si (KR)

(72) Inventors: Se Hyuk Park, Yongin-si (KR); Hong Soo Kim, Yongin-si (KR); Jin Young Roh, Yongin-si (KR); Hyo Jin Lee, Yongin-si (KR); Jae Keun Lim, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/517,736

(22) Filed: Nov. 3, 2021

(65) Prior Publication Data

US 2022/0319409 A1 Oct. 6, 2022

(30) Foreign Application Priority Data

Apr. 1, 2021 (KR) ..... 10-2021-0042663

(51) Int. Cl.
*G09G 3/3225* (2016.01)

(52) U.S. Cl.
CPC ... *G09G 3/3225* (2013.01); *G09G 2300/0842* (2013.01); *G09G 2310/0243* (2013.01); *G09G 2310/08* (2013.01)

(58) Field of Classification Search
CPC ..... G09G 3/3225; G09G 2300/0842; G09G 2310/0243; G09G 2310/08
See application file for complete search history.

(56) References Cited

U.S. PATENT DOCUMENTS

| | | | | |
|---|---|---|---|---|
| 10,056,028 | B2 | 8/2018 | Yamamoto | |
| 2011/0050870 | A1 | 3/2011 | Hanari | |
| 2013/0278572 | A1 | 10/2013 | Lee et al. | |
| 2020/0184904 | A1* | 6/2020 | Jung | G09G 3/3291 |
| 2020/0273409 | A1* | 8/2020 | Hsieh | G09G 3/3291 |

FOREIGN PATENT DOCUMENTS

| | | | |
|---|---|---|---|
| KR | 10-2019-0142791 | A | 12/2019 |
| KR | 10-2070660 | B1 | 1/2020 |

* cited by examiner

*Primary Examiner* — Hang Lin
(74) *Attorney, Agent, or Firm* — Innovation Counsel LLP

(57) ABSTRACT

A display device comprises pixels, an emission control driver, a scan driver, and a timing controller for selecting whether the display device is to operate in a first display mode in which the display device is driven at a first frequency or a second display mode in which the display device is driven at a second frequency lower than the first frequency based on input image data. The first display mode comprises first frame periods, and the second display mode comprises second frame periods having at least two sub-frames having a period equal to the first frame period. A total time required to supply the scan signals to the scan lines in one first frame period of the first frame periods and a total time required to supply the scan signals to the scan lines in one second frame period of the second frame periods are substantially same.

15 Claims, 21 Drawing Sheets

DISPLAY DEVICE

CROSS-REFERENCE TO RELATED APPLICATION

The application claims priority to and the benefit of Korean Patent Application No. 10-2021-0042663, filed Apr. 1, 2021, the disclosure of which is hereby incorporated by reference in its entirety.

BACKGROUND

1. Field

The present disclosure generally relates to a display device.

2. Discussion

With the development of information technologies, the importance of a display device which is a connection medium between a user and information increases. Accordingly, display devices such as a liquid crystal display device and an organic light emitting display device are increasingly used.

A display device displays an image with a combination of lights emitted from pixels based on data voltages written to the pixels. A scan driver is required to select pixels to which data voltages are to be written. The scan driver may be driven using progressive scanning or interlaced scanning according to a driving method.

In the progressive scanning, the scan driver should sequentially output a scan signal to all scan lines for every frame, and therefore, power consumption is high. However, all the scan lines are driven for every frame, and therefore, the progressive scanning is suitable for moving image display. On the other hand, in the interlaced scanning, the scan driver alternately drives odd-numbered scan lines and even-numbered scan lines for every frame, and thus power consumption is low. However, only a half of the scan lines are driven during a sub-frame, and therefore, the interlaced scanning is suitable for still image display.

The display device may operate using any one of the progressive scanning or the interlaced scanning according to the kind of input image. In the display device, the speed at which a scan signal is supplied may be changed between the progressive scanning and the interlaced scanning. Therefore, a flicker phenomenon may occur, in which flickering of a display image is viewed by a user.

SUMMARY

Embodiments provide a display device capable of performing a mode change between progressive scanning and interlaced scanning while preventing a flicker phenomenon.

In accordance with an aspect of the present disclosure, there is provided a display device comprising: a plurality of pixels comprising a plurality of pixels; an emission control driver configured to provide emission control signals to the plurality of pixels; a scan driver configured to provide scan signals to the plurality of pixels; and a timing controller configured to select whether the display device is to operate in any one of a first display mode in which the display device is driven at a first frequency and a second display mode in which the display device is driven at a second frequency lower than the first frequency based on input image data.

The first display mode comprises a plurality of first frame periods and the second display mode comprises a plurality of second frame periods having at least two sub-frames having a period equal to the first frame period. Each of a total time required to supply the scan signals to the plurality of scan lines in the first frame period, a total time required to supply the scan signals to odd-numbered scan lines of the plurality of scan lines in one sub frame period, and a total time required to supply the scan signals to even-numbered scan lines of the plurality of scan lines in another sub frame period is substantially same.

The timing controller may receive the input image data, and output a clock signal, a scan start signal, and image data.

The scan driver may comprise a plurality of stages connected to a plurality of clock signal lines to which the clock signal is provided, the plurality of stages generating the scan signals in response to the scan start signal.

A carry signal may be transferred to a stage after next. The second frame period may comprise a first sub-frame period in which odd-numbered scan signals among the plurality of scan signals are provided to the plurality of pixels and a second sub-frame period in which even-numbered scan signals among the plurality of scan signals are provided to the plurality of pixels.

A cycle of a clock signal of the first frame period may be equal to a cycle of a clock signal of the first sub-frame period and a cycle of a clock signal of the second sub-frame period.

The cycle of the clock signal of the first frame period, the cycle of the clock signal of the first sub-frame period, and the cycle of the clock signal of the second sub-frame period may have four horizontal periods.

The clock signal lines may comprise a first clock line, a second clock line, a third clock line, and a fourth clock line. The first clock line and the third clock line may be alternately connected to first and second clock input terminals of odd-numbered stages among the stages, and the second clock line and the fourth clock line may be alternately connected to first and second clock input terminals of even-numbered stages among the stages.

During the first frame period, the timing controller may sequentially supply, a first clock signal to the first clock line, a second clock signal to the second clock line, a third clock signal to the third clock line, and a fourth clock signal to the fourth clock line.

During the first sub-frame period, the timing controller may provide the first clock signal and the third clock signal of a turn-on level to the first clock line and the third clock line, and provide the second clock signal and the fourth clock signal of a turn-off level to the second clock line and the fourth clock line, respectively.

During the second sub-frame period, the timing controller may provide the first clock signal and the third clock signal of a turn-off level to the first clock line and the third clock line, and provide the second clock signal and the fourth clock signal of a turn-on level to the second clock line and the fourth clock line, respectively.

The display device may further comprise a data driver configured to generate data signals based on the image data. Each of the plurality of pixels may emit light with a luminance corresponding to a data signal in response to a scan signal.

The timing controller may further comprise a luminance controller configured to adjust an off-duty number as a number of pulses of the emission control signal, which are comprised in a predetermined period.

The luminance controller may set the off-duty number of the emission control signal to be 4 during the first frame period of the first display mode and the sub-frame period of the second display mode.

A ratio of an off period to a frame period of the emission control signal may be 50% in all areas of the plurality of pixels during the first frame period and the second frame period.

The timing controller may select the first display mode when grayscale values of the input image data, which correspond to each of consecutive frames, are substantially different from each other, and select the second display mode when grayscale values of the input image data, which correspond to each of consecutive frames, are substantially the same.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

It will be understood that when an element is referred to as being "between" two elements, it can be the only element between the two elements, or one or more intervening elements may also be present. Like reference numerals refer to like elements throughout.

DETAILED DESCRIPTION OF THE ILLUSTRATED EMBODIMENTS

Figure 1:
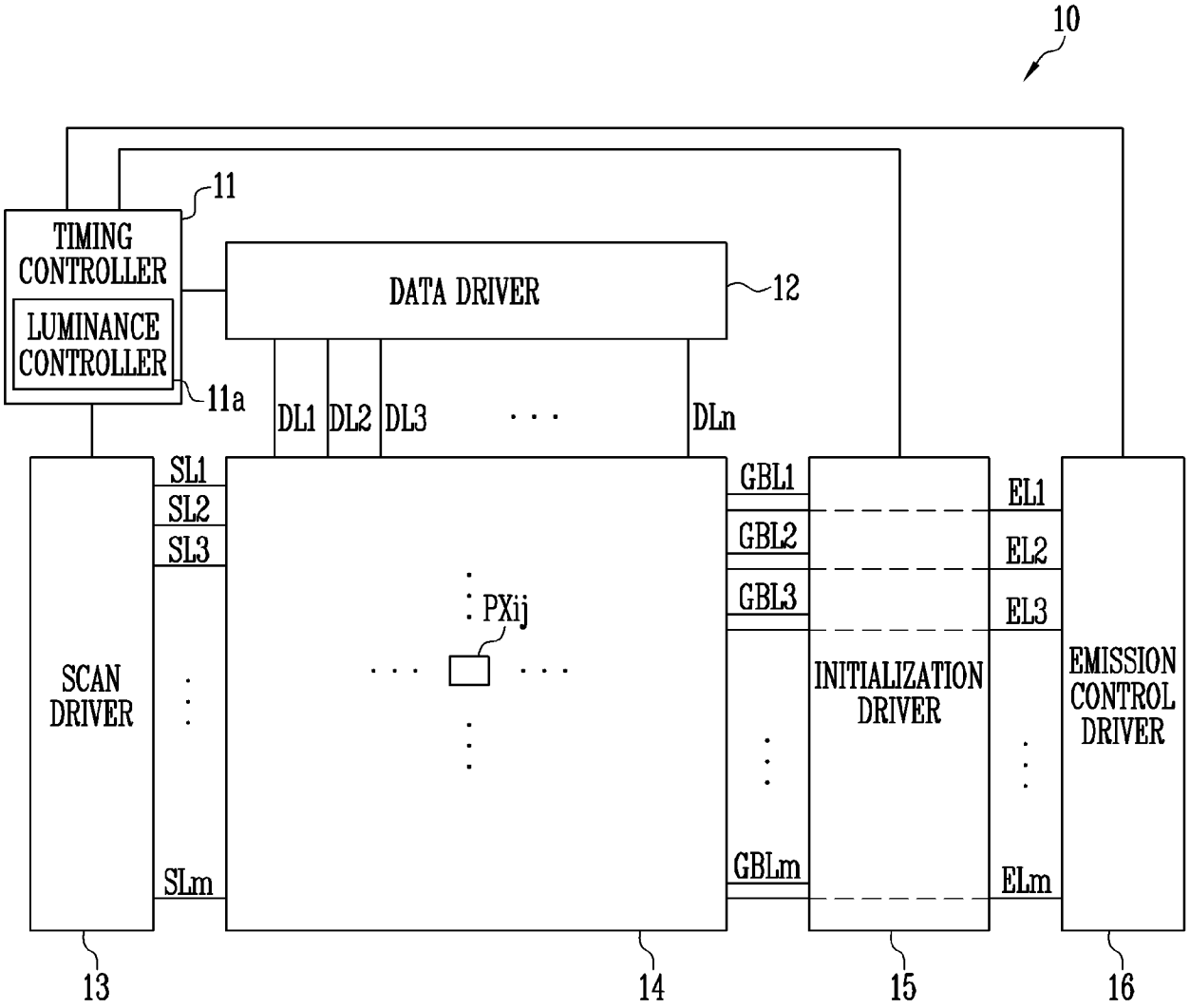
FIG. 1 is a diagram illustrating a display device in accordance with an embodiment of the present disclosure.

Hereinafter, embodiments are described in detail with reference to the accompanying drawings so that those skilled in the art may easily practice the present disclosure. The present disclosure may be implemented in various different forms and is not limited to the embodiments described in the present specification.

A part irrelevant to the description will be omitted to clearly describe the present disclosure, and the same or similar constituent elements will be designated by the same reference numerals throughout the specification. Therefore, the same reference numerals may be used in different drawings to identify the same or similar elements.

In description, the expression "equal" may mean "substantially equal." That is, this may mean equality to a degree to which those skilled in the art can understand the equality. Other expressions may be expressions in which "substantially' is omitted.

Figure 2A:
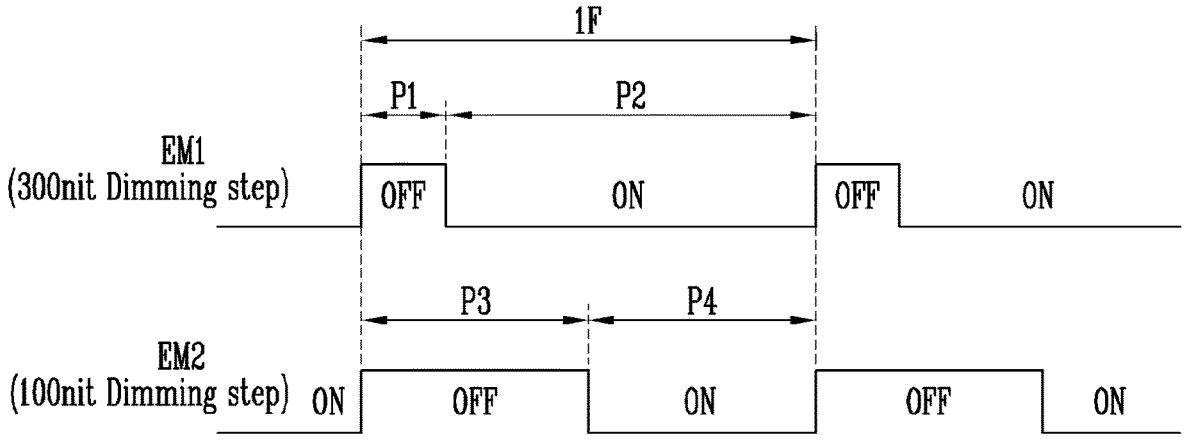
FIG. 2A is a diagram illustrating an AMOLED Impulse Driving (AID) dimming method through off-duty ratio adjustment of an emission control signal.
Figure 2B:
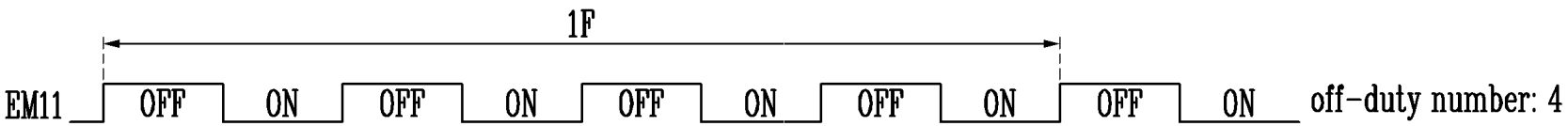
FIG. 2B is a waveform diagram illustrating a change in off-duty number of the emission control signal using the AID dimming method shown in FIG. 2A.

FIG. 1 is a diagram illustrating a display device in accordance with an embodiment of the present disclosure. FIG. 2A is a diagram illustrating an AMOLED Impulse Driving (AID) dimming method through off-duty ratio adjustment of an emission control signal. FIG. 2B is a waveform diagram illustrating a change in off-duty number of the emission control signal using the AID dimming method shown in FIG. 2A. In FIG. 2A, it is illustrated that a state in which emission control signals EM1 and EM2 are logic high is a non-emission state and a state in which the emission control signals EM1 and EM2 are logic low is an emission state. However, the present disclosure is not limited thereto.

Referring to FIG. 1, the display device 10 in accordance with the embodiment of the present disclosure may include a timing controller 11, a data driver 12, a scan driver 13, a plurality of pixels 14, an initialization driver 15, and an emission control driver 16.

The timing controller 11 may receive an external input signal from an external processor. The external input signal may include a vertical synchronization signal, a horizontal synchronization signal, a data enable signal, RGB data (or input image data), and the like. The vertical synchronization signal may include a plurality of pulses, and a time at which each of the pulses is generated may indicate that a previous frame period is ended and a current frame period is started. An interval between adjacent pulses of the vertical synchronization signal may correspond to one frame period. The horizontal synchronization signal may include a plurality of pulses, and a time at which each of the pulses is generated may indicate that a previous horizontal period is ended and a new horizontal period is started. An interval between adjacent pulses of the horizontal synchronization signal may correspond to one horizontal period. The data enable signal may indicate that RGB data is supplied in a horizontal period. The RGB data may be supplied in units of pixel rows in horizontal periods corresponding to the data enable signal. RGB data corresponding to one frame may be referred to as one input image.

The timing controller 11 may determine whether the display device 10 is to operate any one of a first display mode in which the display device 10 is driven at a first frequency (e.g., 60 Hz) and a second display mode at a second frequency (e.g., 30 Hz) lower than the first frequency. For example, when grayscale values of input images in consecutive frames are substantially the same, the timing controller 11 may determine the consecutive input images as a still image. Also, when grayscale values of input images in consecutive frames are substantially different from each other, the timing controller 11 may determine the consecutive input images as a moving image.

Meanwhile, as shown in FIG. 1, the timing controller 11 may include a luminance controller 11*a*. In accordance with an embodiment, the luminance controller 11*a* may adjust a duty cycle of an emission control signal which is a ratio of time the emission control signal is on compared to the time the emission control signal is OFF. The display device 10 may adjust an emission luminance of the plurality of pixels 14 corresponding to the duty cycle. The duty cycle of the emission control signal will be described in detail later with reference to FIGS. 2A and 2B.

The data driver 12 may provide pixels with data voltages corresponding to grayscales of the input image. For example, the data driver 12 may sample grayscales by using a clock signal, and apply data voltages corresponding to the grayscales in units of scan lines to data lines DL1, DL2, DL3, . . . , and DLn. Here, n may be an integer greater than 0.

The scan driver 13 may receive a clock signal, a scan start signal, and the like from the timing controller 11, and generate scan signals to be provided to scan lines SL1, SL2, SL3, . . . , and SLm. Here, m may be an integer greater than 0.

Each pixel PXij may be connected to a corresponding data line among the data lines DL1, DL2, DL3, . . . , and DLn and a corresponding scan line among the scan lines SL1, SL2, SL3, . . . , and SLm. Here, i and j are integers greater than 0. For example, the pixel PXij may mean a pixel in which a scan transistor is connected to an ith scan line and a jth data line.

The initialization driver 15 may supply an initialization signal to initialization lines GBL1, GBL2, GBL3, . . . , and GBLm under the control of the timing controller 11. For example, the initialization driver 15 may sequentially supply the initialization signal to the initialization lines GBL1, GBL2, GBL3, . . . , and GBLm.

The emission control driver 16 may supply an emission control signal to emission control lines EL1, EL2, EL3, . . . , and ELn under the control of the timing controller 11. In an example, the emission control driver 16 may sequentially supply the emission control signal to the emission control lines EL1, EL2, EL3, . . . , and ELn. In accordance with an embodiment, the emission control signal may be set to have a width wider than that of the scan signal. For example, the emission control signal may be supplied to overlap with two scan signals.

Referring to FIG. 2A, the AID dimming method is a method of adjusting a luminance by controlling a duty ratio of emission control signals EM1 and EM2 to correspond to a set dimming step. In the AID dimming method, the luminance is changed by varying an off period P1 or P3 or an on period P2 or P4 in one cycle (e.g., one frame 1F) of the emission control signal for controlling emission and non-emission of the pixel PXij. That is, the luminance is adjusted by controlling an off-duty ratio of the emission control signal, and off-duty ratios may be set to 0%, 20%, 40%, 60%, 80%, and 95%. However, this is merely illustrative, and various duty ratios may be set according to users.

Referring to FIG. 2A, an on period P4 of the emission control signal EM2 in a 100-nit dimming step is shorter than that P2 of the emission control signal EM1 in a 300-nit dimming step. On the contrary, an off period P3 of the emission control signal EM2 in the 100-nit dimming step is longer than that P1 in the 300-nit dimming step. The pixel emits light during on periods of the emission control signals EM1 and EM2, and emits no light during off periods of the emission control signals EM1 and EM2. Therefore, the luminance may be lowered as the on period of the emission control signal decreases and the off period of the emission control signal increases.

Referring to FIGS. 2A and 2B, the emission control signal EM1 or EM2 shown in FIG. 2A represents a case where the off-duty number (or cycle number) of the emission control signal EM1 or EM2 is 1. That is, the number of pulses of the emission control signal EM1 or EM2 which are included in one cycle (e.g., one frame 1F) is 1. Meanwhile, a (1-1)th emission control signal EM11 shown in FIG. 2B represents a case where the off-duty number of the (1-1)th emission control signal EM11 is 4. That is, the number of pulses of the emission control signal EM11 which are included in one cycle (e.g., one frame 1F) is 4. For convenience of description, only a case where the off-duty number is 4 has been illustrated in FIG. 2B. However, a case where the off-duty number is 2 means a case where the number of pulses of the emission control signal which are included in one cycle (e.g., one frame 1F) is 2, and a case where the off-duty number is 8 means a case where the number of pulses of the emission control signal which are included in one cycle (e.g., one frame 1F) is 8. The luminance may be lowered as the number of pulses of the emission control signal EM1, EM2 or EM11, which are included in the same cycle (e.g., one frame 1F), increases. In other words, the luminance may be lowered as the off-duty number of the emission control signal EM1, EM2 or EM11 increases.

Figure 3:
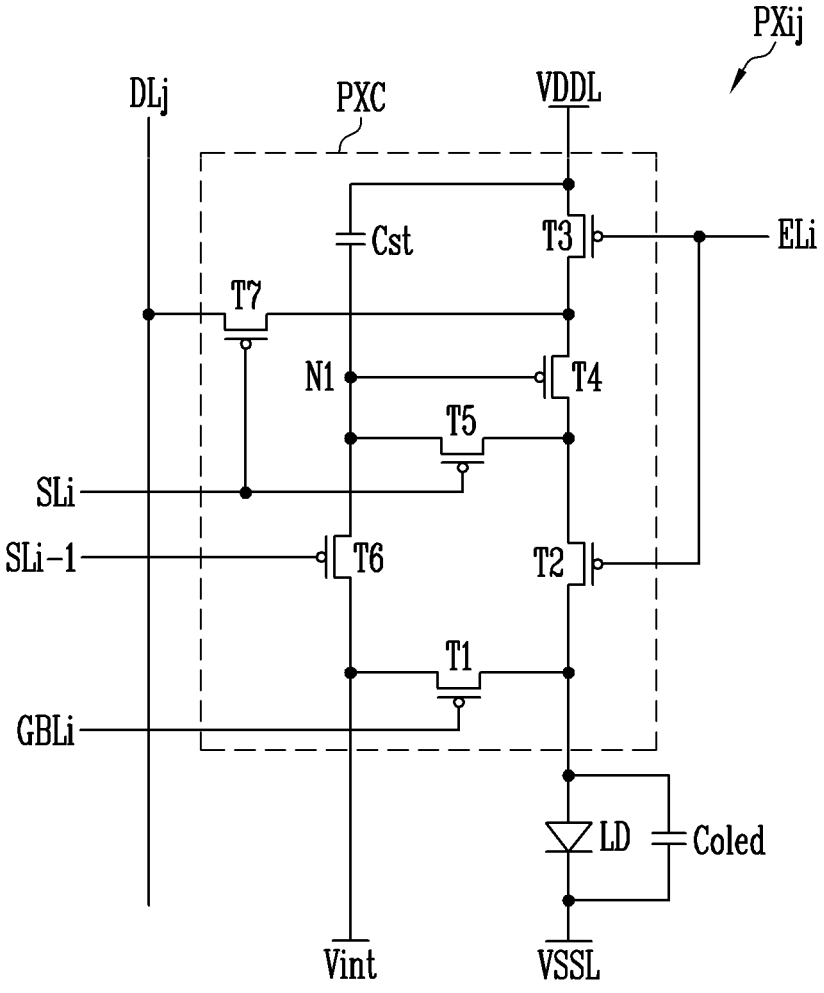
FIG. 3 is a diagram illustrating a pixel in accordance with an embodiment of the present disclosure.

FIG. 3 is a diagram illustrating a pixel in accordance with an embodiment of the present disclosure. A pixel PXij connected to an ith scan line SLi and the jth data line DLj will be illustrated in FIG. 3.

Referring to FIG. 3, the pixel PXij in accordance with the embodiment of the present disclosure may include a light emitting diode LD, first to seventh transistor T1 to T7, and a storage capacitor Cst.

An anode electrode of the light emitting diode LD may be connected to a pixel circuit PXC, and a cathode electrode of the light emitting diode LD may be connected to a second pixel power line VSSL. The light emitting diode LD may generate light with a predetermined luminance corresponding to an amount of current supplied from the pixel circuit PXC.

The pixel circuit PXC may control an amount of current flowing from a first pixel power line VDDL to the second pixel power line VSSL via the light emitting diode LD corresponding to a data signal. In an example, the pixel circuit PXC may initialize a gate electrode of the fourth transistor T4 (or driving transistor) when a scan signal is supplied to an (i−1)th scan line SLi−1, and store a data signal supplied from a jth data line DLj to the storage capacitor Cst when the scan signal is supplied to an ith scan line SLi. Also, the pixel circuit PXC may control an amount of current supplied to the light emitting diode LD corresponding to the data signal when an emission control signal is supplied to an ith emission control line ELi.

The pixel circuit PXC may be implemented with various types of circuits currently known in the art. In addition, the first pixel power line VDDL may be set to a voltage higher than that of the second pixel power line VSSL such that the current can flow from the first pixel power line VDDL to the second pixel power line VSSL through the light emitting diode LD.

The first transistor T1 may be connected between an initialization power source Vint and the anode electrode of the light emitting diode LD. In addition, a gate electrode of the first transistor T1 may be connected to an ith initialization line GBLi (or control line). The first transistor T1 may be turned on when an initialization signal is supplied to the ith control line GBLi to supply a voltage of the initialization power source Vint to the anode electrode of the light emitting diode LD. The initialization power source Vint may be set to a voltage lower than the data signal.

The second transistor T2 may be connected between the fourth transistor T4 and the anode electrode of the light emitting diode LD. In addition, a gate electrode of the second transistor T2 may be connected to the ith emission control line ELi. The second transistor T2 may be turned off when the emission control signal is supplied to the ith emission control line ELi and be turned on in other cases.

The third transistor T3 may be connected between the first pixel power line VDDL and the fourth transistor T4. In addition, a gate electrode of the third transistor T3 may be connected to the ith emission control line ELi. The third transistor T3 may be turned off when the emission control signal is supplied to the ith emission control line ELi and be turned on in other cases.

A first electrode of the fourth transistor T4 (or driving transistor) may be connected to the first pixel power line VDDL via the third transistor T3, and a second electrode of the fourth transistor T4 may be connected to the anode electrode of the light emitting diode LD via the second transistor T2. In addition, the gate electrode of the fourth transistor T4 may be connected to a first node N1. The fourth transistor T4 may control the amount of current flowing from the first pixel power line VDDL to the second pixel power line VSSL via the light emitting diode LD corresponding to a voltage of the first node N1.

The fifth transistor T5 may be connected between the second electrode of the fourth transistor T4 and the first node N1. In addition, a gate electrode of the fifth transistor T5 may be connected to the ith scan line SLi. The fifth transistor T5 may be turned on when the scan signal is supplied to the ith scan line SLi to electrically connect the second electrode of the fourth transistor T4 and the first node N1 to each other. Therefore, the fourth transistor T4 may be diode-connected when the fifth transistor T5 is turned on.

The sixth transistor T6 may be connected between the first node N1 and the initialization power source Vint. In addition, a gate electrode of the sixth transistor T6 may be connected to the (i−1)th scan line SLi−1. The sixth transistor T6 may be turned on when the scan signal is supplied to the (i−1)th scan line SLi−1 to supply the voltage of the initialization power source Vint to the first node N1.

The seventh transistor T7 may be connected between the jth data line DLj and the first electrode of the fourth transistor T4. In addition, a gate electrode of the seventh transistor T7 may be connected to the ith scan line SLi. The seventh transistor T7 may be turned on when the scan signal is supplied to the ith scan line SLi, to electrically connect the jth data line DLj and the first electrode of the fourth transistor T4 to each other.

The storage capacitor Cst may be connected between the first pixel power line VDDL and the first node N1. The storage capacitor Cst may store a voltage corresponding to the data signal and a threshold voltage of the fourth transistor T4.

Figure 4:
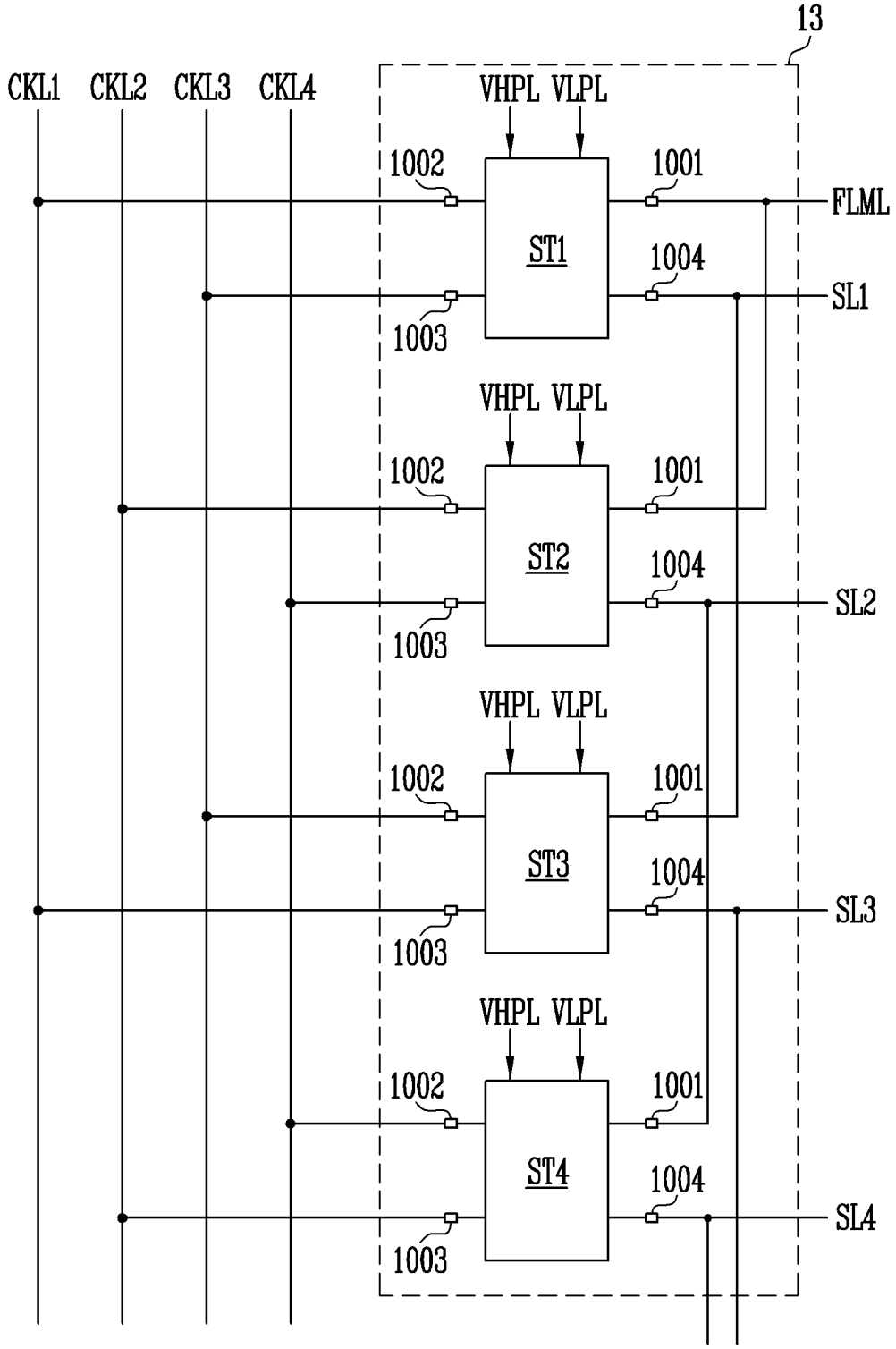
FIG. 4 is a diagram illustrating a scan driver in accordance with an embodiment of the present disclosure.

FIG. 4 is a diagram illustrating a scan driver in accordance with an embodiment of the present disclosure.

The scan driver 13 may include odd-numbered stages ST1, ST3, . . . connected to odd-numbered scan lines SL1, SL3, . . . and even-numbered stages ST2, ST4, . . . connected to even-numbered scan lines SL2, SL4, . . . . For example, first and third scan lines SL1 and SL3 may be respectively connected to first and third stages ST1 and ST3. In addition, second and fourth scan lines SL2 and SL4 may be respectively connected to second and fourth stages ST2 and ST4.

Each of the first to fourth stages ST1 to ST4 may include a first input terminal 1001, a second input terminal 1002 (or first clock input terminal), a third input terminal 1003 (or second clock input terminal), and an output terminal 1004.

The first stage ST1 among the odd-numbered stages ST1, ST3, . . . and the second stage ST2 among the even-numbered stages ST2, ST4, . . . may be connected to the same scan start line FLML. For example, a first input terminal 1001 of the first stage ST1 and a first input terminal 1001 of the second stage ST2 may be connected to the same scan start line FLML. An output terminal 1004 of the first stage ST1 may be connected to a first scan line SL1, and an output terminal 1004 of the second stage ST2 may be connected to a second scan line SL2.

Each of the odd-numbered stages ST3, . . . except the first stage ST1 may be connected to a scan line (or carry line) of a previous odd-numbered stage. Each of the even-numbered stages ST4, . . . except the second stage ST2 may be connected to a scan line (or carry line) of a previous even-numbered stage. For example, a first input terminal 1001 of the third stage ST3 may be connected to the first scan line SL1 of the first stage ST1. In addition, a first input terminal 1001 of the fourth stage ST4 may be connected to the second scan line SL2 of the second stage ST2.

The odd-numbered stages ST1, ST3, . . . may be connected to first and third clock lines CKL1 and CKL3. The first and third clock lines CKL1 and CKL3 may be alternately connected to second and third input terminals 1002 and 1003 of the odd-numbered stages ST1, ST3, . . . . The even-numbered stages ST2, ST4, . . . may be connected to second and fourth clock lines CKL2 and CKL4 different from the first and third clock lines CKL1 and CKL3. The second and fourth clock lines CKL2 and CKL4 may be alternately connected to second and third input terminals 1002 and 1003 of the even-numbered stages ST2, ST4, . . . .

Each of the first to fourth stages ST1 to ST4 may be connected to a first power line VHPL and a second power line VLPL. The voltage of the first power line VHPL may be set to a turn-off level (gate-off voltage, logic high level). In addition, the voltage of the second power line VLPL may be set to a turn-on level (gate-on voltage, logic low level).

Figure 5:
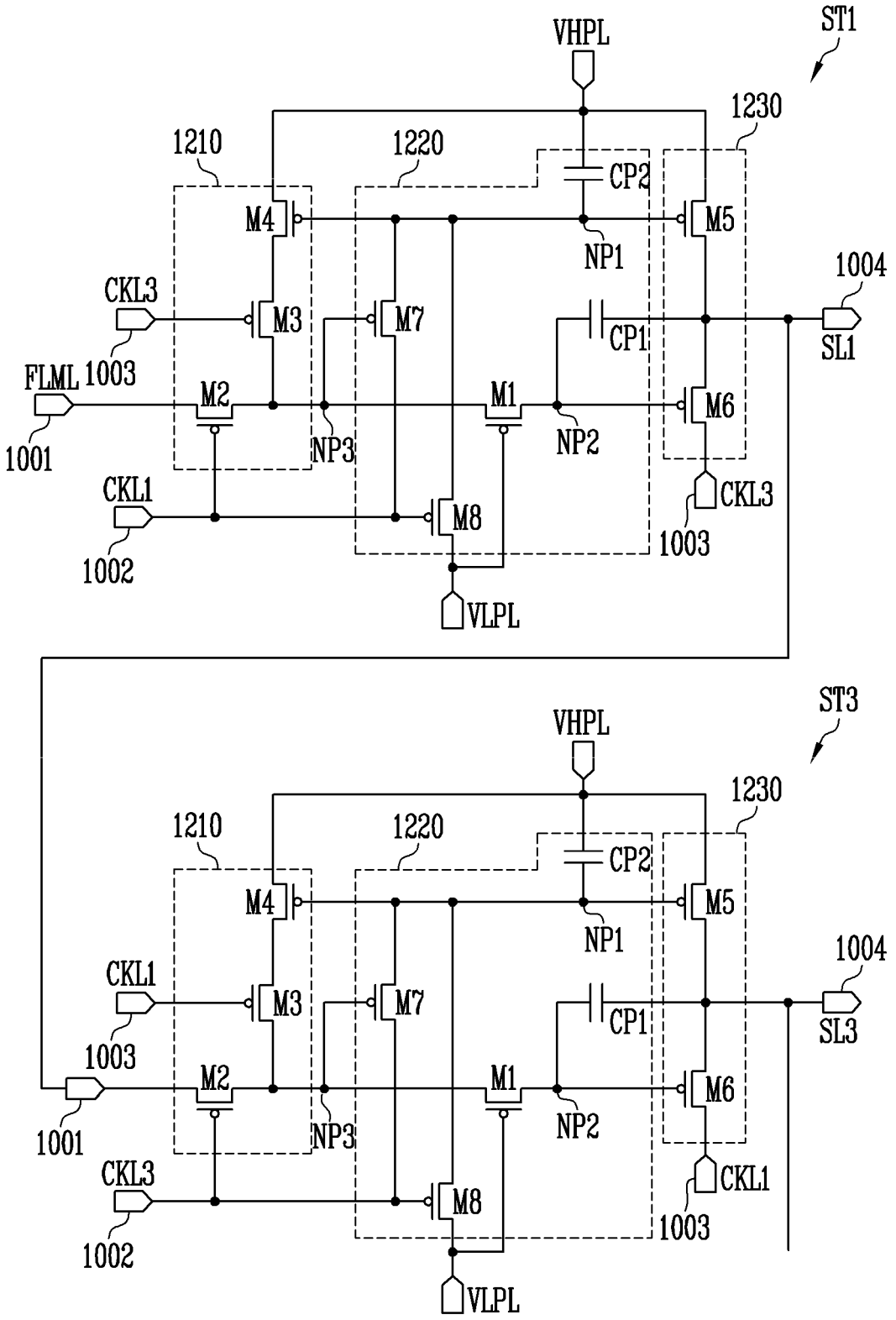
FIG. 5 is a diagram illustrating a stage in accordance with an embodiment of the present disclosure.

FIG. 5 is a diagram illustrating a stage in accordance with an embodiment of the present disclosure.

For convenience of description, the first stage ST1 and the third stage ST3 will be illustrated in FIG. 5. Referring to FIG. 5, the first stage ST1 may include a first driver 1210, a second driver 1220, and an output circuit 1230.

The output circuit 1230 controls a voltage supplied to the output terminal 1004 in response to voltages of a first node NP1 and a second node NP2. To this end, the output circuit 1230 includes a fifth transistor M5 and a sixth transistor M6.

The fifth transistor T5 is connected between the first power line VHPL and the output terminal 1004, and a gate electrode of the fifth transistor M5 is connected to the first node NP1. The fifth transistor M5 controls connection between the first power line VHPL and the output terminal 1004 in response to the voltage applied to the first node NP1.

The sixth transistor M6 is connected between the output terminal 1004 and the third input terminal 1003, and a gate electrode of the sixth transistor M6 is connected to the second node NP2. The sixth transistor M6 controls connection between the output terminal 1004 and the third input terminal 1003 in response to the voltage applied to the second node NP2. The output circuit 1230 is a buffer circuit.

Additionally, the fifth transistor M5 and the sixth transistor M6 may be configured such that a plurality of transistors are connected in parallel.

The first driver 1210 controls a voltage of a third node NP3 in response to signals supplied to the first to third input terminal 1001 to 1003. To this end, the first driver 1210 includes second to fourth transistors M2 to M4.

The second transistor M2 is connected between the first input terminal 1001 and the third node NP3, and a gate electrode of the second transistor M2 is connected to the second input terminal 1002. The second transistor M2 controls connection between the first input terminal 1001 and the third node NP3 in response to a signal supplied to the second input terminal 1002.

The third transistor M3 and the fourth transistor M4 are connected in series between the third node NP3 and the first power line VHPL. The third transistor M3 is connected between the fourth transistor 4 and the third node NP3, and a gate electrode of the third transistor M3 is connected to the third input terminal 1003. The third transistor M3 controls connection between the fourth transistor M4 and the third node NP3 in response to a signal supplied to the third input terminal 1003.

The fourth transistor M4 is located between the third transistor M3 and the first power line VHPL, and a gate electrode of the fourth transistor M4 is connected to the first node NP1. The fourth transistor M4 controls connection between the third transistor M3 and the first power line VHPL in response to the voltage of the first node NP1.

The second driver 1220 controls the voltage of the first node NP1 in response to voltages of the second input terminal 1002 and the third node NP3. To this end, the second driver 1220 includes a first transistor M1, a seventh transistor M7, an eighth transistor M8, a first capacitor CP1, and a second capacitor CP2.

The first capacitor CP1 is connected between the second node NP2 and the output terminal 1004. The first capacitor CP1 charges a voltage corresponding to turn-on and turn-off of the sixth transistor M6.

The second capacitor CP2 is connected between the first node NP1 and the first power line VHPL. The second capacitor CP2 charges the voltage applied to the first node NP1.

The seventh transistor M7 is connected between the first node NP1 and the second input terminal 1002, and a gate electrode of the seventh transistor M7 is connected to the third node NP3. The seventh transistor M7 controls connection between the first node NP1 and the second input terminal 1002 in response to the voltage of the third node NP3.

The eighth transistor M8 is connected between the first node NP1 and the second power line VLPL, and a gate electrode of the eighth transistor M8 is connected to the second input terminal 1002. The eighth transistor M8 controls connection between the first node NP1 and the second power line VLPL in response to the signal of the second input terminal 1002.

The first transistor M1 is connected between the third node NP3 and the second node NP2, and a gate electrode of the first transistor M1 is connected to the second power line VLPL. The first transistor M1 maintains electrical connection between the third node NP3 and the second node NP2 while maintaining a turn-on state. Additionally, the first transistor M1 limits a voltage drop of the third node NP3. In other words, although the voltage of the second node NP2 drops to a voltage lower than that of the second power line VLPL, the voltage of the third node NP3 does not become lower than a voltage obtained by subtracting a threshold voltage of the first transistor M1 from the voltage of the second power line VLPL.

Figure 6:
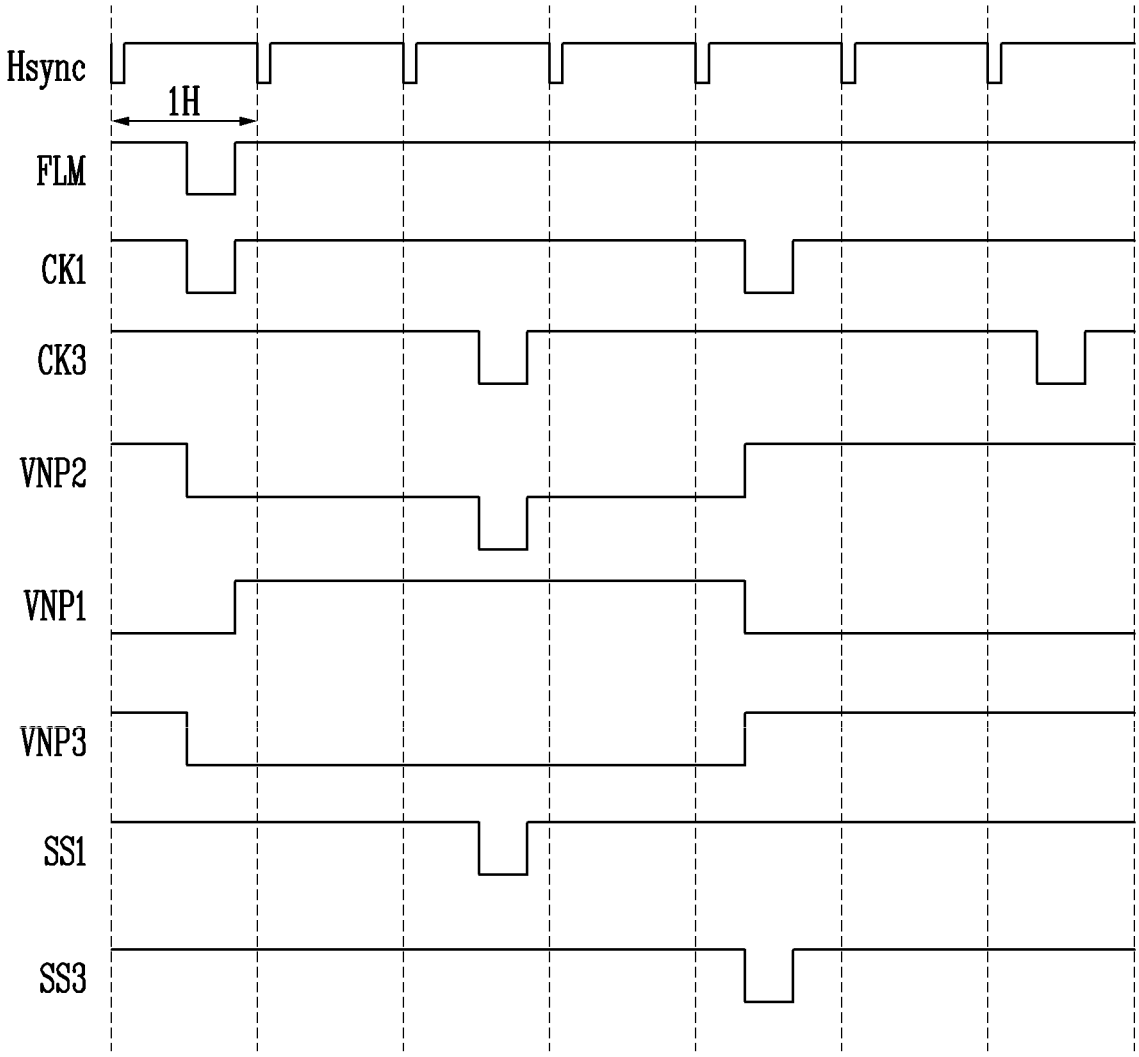
FIG. 6 is a diagram illustrating a driving method of the scan driver in accordance with an embodiment of the present disclosure.

FIG. 6 is a diagram illustrating a driving method of the scan driver in accordance with an embodiment of the present disclosure. In FIG. 6, for convenience of description, an operation process in the first stage ST1 will be described.

Referring to FIG. 6, a first clock signal CK1 and a third clock signal CK3 have a cycle of four horizontal periods 4H, and are supplied in different horizontal periods. In other words, the third clock signal CK3 is set as a signal shifted by a half cycle (i.e., two horizontal periods) from the first clock signal CK1. In addition, a scan start signal FLM supplied to the first input terminal 1001 of the first stage ST1 may be synchronized with the first clock signal CK1 supplied to the second input terminal 1002 of the first stage ST1. One horizontal period 1H may correspond to a cycle of pulses of a horizontal synchronization signal Hsync.

That specific signals are supplied may mean that the specific signals have a turn-on level (i.e., a logic low level) is supplied. That the supply of specific signals is suspended may mean that the specific signals have a turn-off level (i.e., a logic high level) is suspended.

Additionally, when the scan start signal FLM is supplied, the first input terminal 1001 may be set to a voltage of the logic low level. When the scan start signal FLM is not supplied, the first input terminal 1001 may be set to a voltage of the logic high level. In addition, when a clock signal is supplied to the second input terminal 1002 and the third input terminal 1003, the second input terminal 1002 and the third input terminal 1003 may be set to a voltage of the logic low level. When the clock signal is not supplied to the second input terminal 1002 and the third input terminal 1003, the second input terminal 1002 and the third input terminal 1003 may be set to a voltage of the logic high level.

The operation process will be described in detail. First, the scan start signal FLM synchronized with the first clock signal CK1 is supplied to the first scan stage ST1.

When the first clock signal CK1 is supplied, the second transistor M2 and the eighth transistor M8 are turned on. When the second transistor M2 is turned on, the first input terminal 1001 and the third node NP3 are electrically connected to each other. The first transistor M1 is set to the turn-on state in most periods, and hence the second node NP2 maintains electrical connection with the third node NP3.

When the first input terminal 1001 and the third node NP3 are electrically connected to each other, voltages VNP2 and VNP3 of the second node NP2 and the third node NP3 are set to a low level by the scan start signal FLM supplied to the first input terminal 1001. When the voltages VNP2 and VNP3 of the second node NP2 and the third node NP3 are set to the low level, the sixth transistor M6 and the seventh transistor M7 are turned on.

When the sixth transistor M6 is turned on, the third input terminal 1003 and the output terminal 1004 are electrically connected to each other. The third input terminal 1003 is set to a voltage of a high level (i.e., the third clock signal CK3 is not supplied), and accordingly, the voltage of the high level is also output to the output terminal 1004. When the seventh transistor M7 is turned on, the second input terminal 1002 and the first node NP1 are electrically connected. A voltage VNP1 of the first node NP1 is set to the low level according to the first clock signal CK1 supplied to the second input terminal 1002.

Additionally, when the first clock signal CK1 is supplied, the eighth transistor M8 is turned on. When the eighth transistor M8 is turned on, a voltage of the second power line VLPL is supplied to the first node NP1. The voltage of the second power line VLPL is set as a voltage equal (or similar) to the voltage of the low level of the first clock signal CK1, and accordingly, the first node NP1 stably maintains the voltage of the low level.

When the first node NP1 is set to the voltage of the low level, the fourth transistor M4 and the fifth transistor M5 are turned on. When the fourth transistor M4 is turned on, the first power line VHPL and the third transistor M3 are electrically connected to each other. The third transistor M3 is set to a turn-off state, and hence the third node NP3 stably maintains the voltage of the low level even when the fourth transistor M4 is turned on. When the fifth transistor M5 is turned on, a voltage of the first power line VHPL is supplied to the output terminal 1004. The voltage of the first power line VHPL is set as a voltage equal (or similar) to the voltage of the high level, which is supplied to the third input terminal 1003, and accordingly, the output terminal 1004 stably maintains the voltage of the high level.

Subsequently, the supply of the scan start signal FLM and the first clock signal cK1 is suspended. When the supply of the first clock signal CK1 is suspended, the second transistor M2 and the eighth transistor M8 are turned off. The sixth transistor M6 and the seventh transistor M7 maintain the turn-on state due to a voltage stored in the first capacitor CP1. That is, the second node NP2 and the third node NP3 maintain the voltage of the low level by the voltage stored in the first capacitor CP1.

When the sixth transistor M6 maintains the turn-on state, the output terminal 1004 and the third input terminal 1003 maintains the electrical connection therebetween. When the seventh transistor M7 maintains the turn-on state, the first node NP1 maintains the electrical connection with the second input terminal 1002. The voltage of the second input terminal 1002 is set as the voltage of the high level because the first clock signal CK1 is suspended, and accordingly, the voltage VNP1 of the first node NP1 is also set as the voltage of the high level. When the voltage of the high level is supplied to the first node NP1, the fourth transistor M4 and the fifth transistor M5 are turned off.

Subsequently, the third clock signal CK3 is supplied to the third input terminal 1003. The sixth transistor M6 is set to the turn-on state, and hence the third clock signal CK3 supplied to the third input terminal 1003 is supplied to the output terminal 1004. The output terminal 1004 outputs the third clock signal CK3 as a first scan signal SS1 of the turn-on level to the first scan line SL1.

Meanwhile, when the third clock signal CK3 is supplied to the output terminal 1004, the voltage of the second node NP2 is dropped to a voltage lower than that of the second power line VLPL, and accordingly, the sixth transistor M6 stably maintains the turn-on state.

Meanwhile, although the voltage of the second node NP2 is dropped, the third node NP3 can maintain approximately the voltage of the second power line VLPL (e.g., the voltage obtained by subtracting the threshold voltage of the first transistor M1 from the voltage of the second power line VLPL) due to the first transistor M1 which is turned on.

After the first scan signal SS1 of the turn-on level is output to the first scan line SL1, the supply of the third clock signal CK3 is suspended. When the supply of the third clock signal CK3 is suspended, the output terminal 1004 outputs the voltage of the high level. In addition, the voltage VNP2 of the second node NP2 rises to approximately the voltage of the second power line VLPL which corresponds to the voltage of the high level outputting from the output terminal 1004.

Subsequently, the first clock signal CK1 is supplied. When the first clock signal CK1 is supplied, the second transistor M2 and the eighth transistor M8 are turned on. When the second transistor M2 is turned on, the first input terminal 1001 and the third node NP3 are electrically connected to each other. The scan start signal FLM is not supplied to the first input terminal 1001, and accordingly, the third node NP3 is set to the voltage of the high level. Therefore, the voltage of the high level is supplied to the third node NP3 and the second node NP2, and accordingly, the sixth transistor M6 and the seventh transistor M7 are turned off.

When the eighth transistor M8 is turned on, the voltage of the second power line VLPL is supplied to the first node NP1, and accordingly, the fourth transistor M4 and the fifth transistor M5 are turned on. When the fifth transistor M5 is turned on, the voltage of the first power line VHPL is supplied to the output terminal 1004. Subsequently, the fourth transistor M4 and the fifth transistor M5 maintain the turn-on state due to the voltage charged in the second capacitor CP2, and accordingly, the output terminal 1004 is stably supplied with the voltage of the first power line VHPL.

Additionally, when the third clock signal CK3 is supplied, the third transistor M3 is turned on. The fourth transistor M4 is set to the turn-on state, and hence the voltage of the first power line VHPL is supplied to the third node NP3 and the second node NP2. The sixth transistor M6 and the seventh transistor M7 stably maintain the turn-off state.

The third stage ST3 is supplied with an output signal (i.e., a scan signal) of the first stage ST1 which is synchronized with the third clock signal CK3. The third stage ST3 outputs a third scan signal SS3 of the turn-on level which is synchronized with the first clock signal CK1 to the third scan line SL3. The odd-numbered stages ST1, ST3, . . . sequentially output a scan signal of the turn-on level to the odd-numbered scan lines SL1, SL3, . . . while repeating the above-described process.

In FIGS. 5 and 6, descriptions of the odd-numbered stages ST1, ST3, . . . may be applied substantially identically to the even-numbered stages ST2, ST4, . . . . The stage and the driving method thereof, shown in FIGS. 5 and 6, are merely illustrative, and a conventional stage and a driving method thereof may be used to constitute embodiments of the present disclosure.

FIGS. 7 to 12 are diagrams illustrating a first frame period and a second frame period in accordance with an embodiment of the present disclosure. As shown in FIG. 2B, it is assumed that the off-duty number (or cycle number) of the emission control signal EM11 of the display device 10 is 4. That is, the number of pulses of the emission control signal EM11 which are included in one cycle (e.g., FP1, SFP1, and SFP2), is 4 (or the off-duty number included in a first frame period FP1 is 4 and the off-duty number included in a second frame period FP2 is 8). However, the off-duty number (or cycle number) of the emission control signal is merely illustrative, and the present disclosure is not limited thereto.

The display device 10 may operate in a first display mode including a plurality of first frame periods FP1, or operate in a second display mode including a plurality of second frame periods FP2. The second frame period FP2 may be longer than the first frame period FP1. For example, the second frame period FP2 may be integer times of the first frame period FP1. In other words, the second frame period FP2 may be 2p times of the first frame period FP1. Here, p may be an integer greater than 0. In the embodiment shown in FIG. 7, the second frame period FP2 is twice of the first frame period FP1.

The first display mode is suitable for moving image display since input images (frames) are displayed at a high frequency and the second display mode is suitable for still image display since input images (frames) are displayed at a low frequency. When a still image is detected while a moving image is displayed, the mode of the display device 10 may be changed from the first display mode to the second display mode. Also, when a moving image is detected while a still image is displayed, the mode of the display device 10 may be changed from the second display mode to the first display mode.

Figure 7:
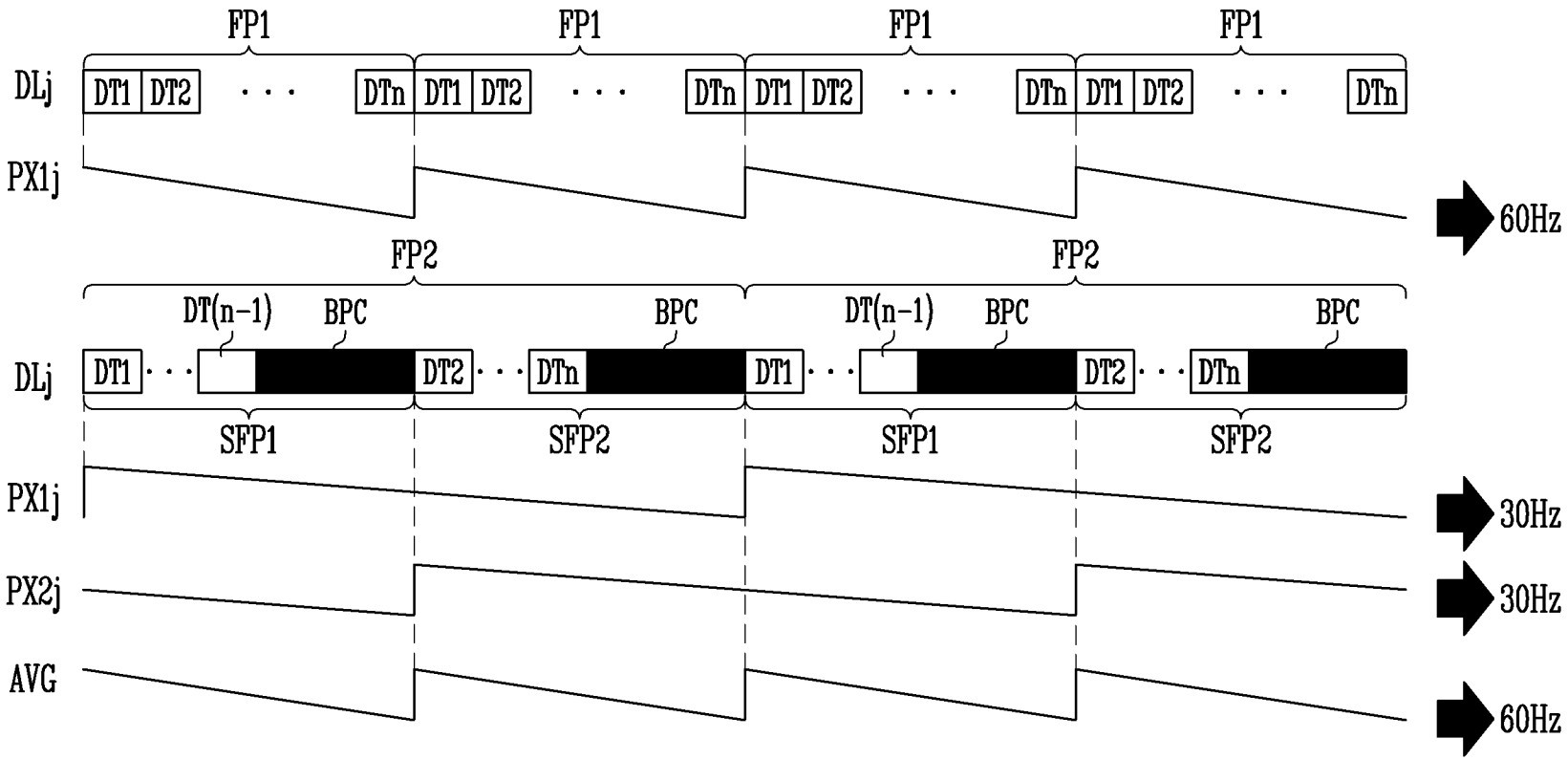
FIGS. 7, 8, 9, 10, 11 and 12 are diagrams illustrating a first frame period and a second frame period in accordance with an embodiment of the present disclosure.

Referring to FIG. 7, for convenience of description, a jth data line DLj and pixels PX1*j* and PX2*j* will be mainly described. A first pixel PX1*j* is connected to the jth data line DLj and the first scan line SL1, and a second pixel PX2*j* is connected to the jth data line DLj and the second scan line SL2.

In each first frame period FP1, the data driver 12 may sequentially apply data voltages corresponding to the scan lines to the data lines. For example, the data driver 12 may sequentially apply data voltages DT1, DT2, . . . , DT(n−1), and DTn to the jth data line DLj. When assuming that the first frame period FP1 is 1/60 second, a first data voltage DT1 may be supplied to the first pixel PX1*j* at 60 Hz. Therefore, the first pixel PX1*j* emits light with a highest luminance at a time at which the first data voltage DT1 is to be applied, and then the luminance may gradually decrease due to a leakage current. Referring to FIG. 7, a luminance waveform of the first pixel PX1*j* in the plurality of first frame periods FP1 is illustrated.

Each second frame period FP2 may include a first sub-frame period SFP1 and a second sub-frame period SFP2. Lengths of the first sub-frame period SFP1 and the second sub-frame period SFP2 may be the same. For example, when assuming that the second frame period FP2 is 1/30 second, the first sub-frame period SFP1 and the second sub-frame period SFP2 may be 1/60 second.

In each first sub-frame period SFP1, the data driver may sequentially apply data voltages corresponding to an odd-numbered pixel row to the data lines. For example, the data driver 12 may sequentially apply data voltages DT1, DT3, . . . , and DT(n−1) to the jth data line DLj. In each second sub-frame period, the data driver 12 may sequentially apply data voltages corresponding to an even-numbered pixel row to the data lines. For example, the data driver 12 may sequentially apply data voltages DT2, DT4, . . . , DTn to the jth data line DLj.

Accordingly, a first data voltage DT1 may be supplied to the first pixel PX1*j* at 30 Hz. Therefore, the first pixel PX1*j* emits light with a highest luminance at a time at which the first data voltage DT1 is to be applied, and then the luminance may gradually decrease due to a leakage current. Referring to FIG. 7, a luminance waveform of the second pixel PX2*j* during the plurality of second frame periods FP2 is illustrated.

The first pixel PX1*j* and the second pixel PX2*j* are located adjacent to each other, for example, along the column direction, and therefore, the first data voltage DT1 and the second data voltage DT2 in a normal input image may be generally equal or similar to each other.

Since the time at which the first pixel PX1*j* has the highest luminance and the time at which the second pixel PX2*j* has the highest luminance are alternately located, a user may recognize the image as 60 Hz and an average luminance waveform AVG of the first pixel PX1*j* and the second pixel PX2*j* is recognize as a luminance. In this case, the user may recognizes images as if the images are displayed in 60 Hz even when the images are displayed in 30 Hz. Accordingly, although a mode change between the first display mode and the second display mode is made, the view of a flicker due to a difference in luminance waveform can be prevented. However, as will be described later with reference to FIG. 12, when the mode of the display device 10 is changed from the first display mode to the second display mode or is changed from the second display mode to the first display mode in an operation of the display device using the AID dimming method through the adjustment of an off-duty ratio of an emission control signal, the off-duty ratio of the emission control signal may be changed for each position of the plurality of pixels 14. Therefore, a luminance difference occurs for each position of the plurality of pixels 14, and hence image quality characteristics may be deteriorated.

Figure 8:
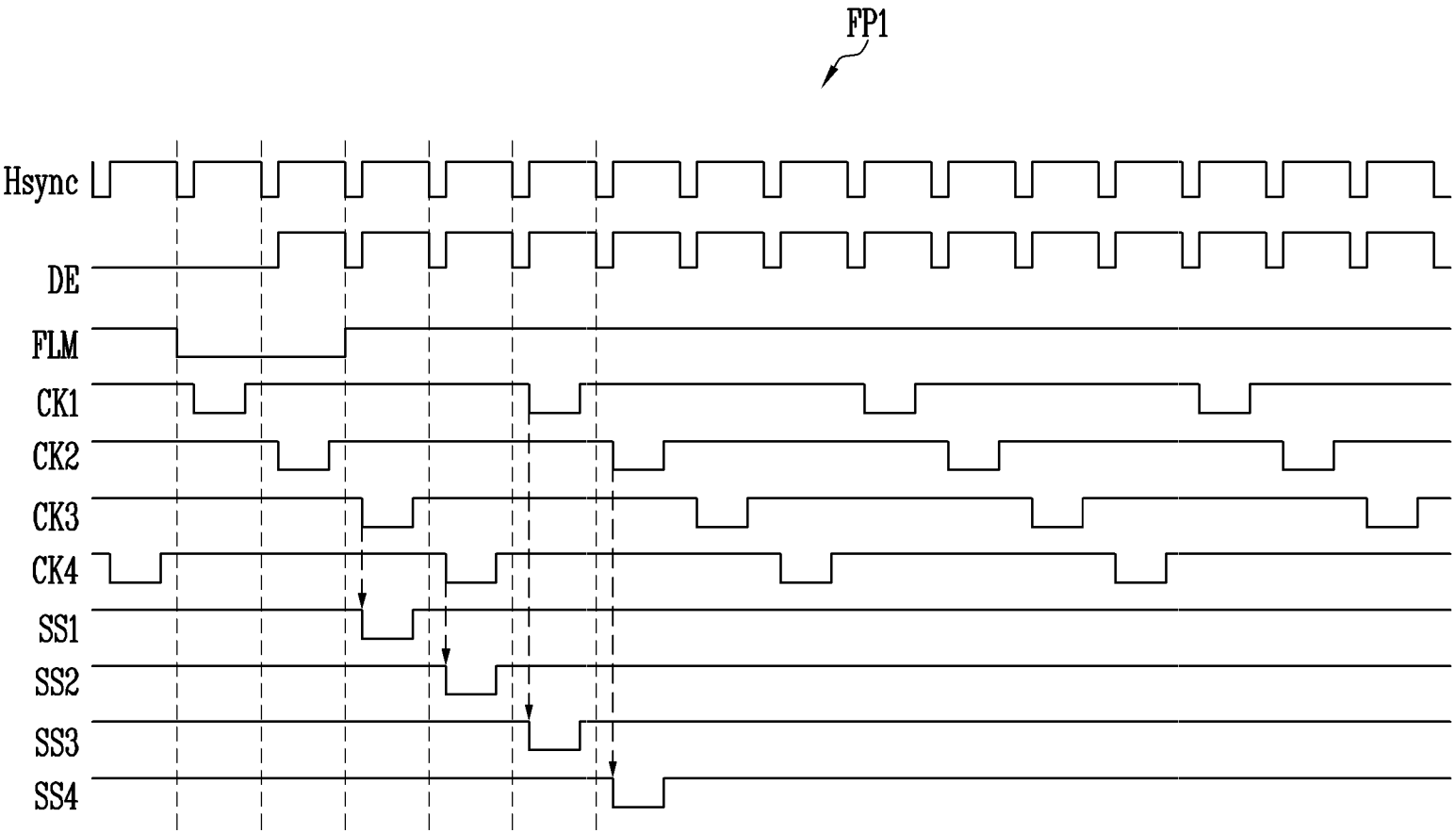

Referring to FIG. 8, control signals in the first frame period FP1 are illustrated.

During the first frame period FP1, the timing controller 11 may apply the first and third clock signals CK1 and CK3 of the turn-on level respectively to the first to third clock lines CKL1 and CKL3, and apply the second and fourth clock signals CK2 and CK4 of the turn-on level respectively to the second and fourth clock lines CKL2 and CKL4. The first to fourth clock signals CK1 to CK4 may have different phases. For example, the clock signals CK1, CK2, CK3, and CK4 of the turn-on level may be sequentially supplied in an order of the first clock line CKL1, the second clock line CKL2, the third clock line CKL3, and the fourth clock line CKL4. For example, the cycle of each of the clock signals CK1, CK2, CK3, and CK4 of the turn-on level may have four horizontal periods.

Also, the timing controller 11 may apply the scan start signal FLM of the turn-on level to the scan start line FLML. The scan start signal FLM of the turn-on level may be set to overlap with the first clock signal CK1 of the turn-on level and the second clock signal CK2 of the turn-on level. For example, the length of the scan start signal FLM of the turn-on level may cover two horizontal periods.

During the first frame period FP1, the scan driver 13 may sequentially apply scan signals SS1, SS2, SS3, and SS4 of the turn-on level to the first scan line SL1, the second scan line SL2, the third scan line SL3, and the fourth scan line SL4.

Referring to the driving method shown in FIG. 6, a first scan signal SS1 of the turn-on level may be generated corresponding to the third clock signal CK3 of the turn-on level. In addition, a second scan signal SS2 of the turn-on level may be generated corresponding to the fourth clock signal CK4 of the turn-on level. Similarly, a third scan signal SS3 of the turn-on level may be generated corresponding to the first clock signal CK1 of the turn-on level. In addition, a fourth scan signal SS4 of the turn-on level may be generated corresponding to the second clock signal CK2 of the turn-on level.

The data driver 12 may supply data voltages to the data lines in synchronization with the scan signals SS1, SS2, SS3, and SS4. For example, the data driver 12 may supply data voltages in a current horizontal period corresponding to grayscales latched by the data enable signal DE of the logic high level in a previous horizontal period.

Figure 9:
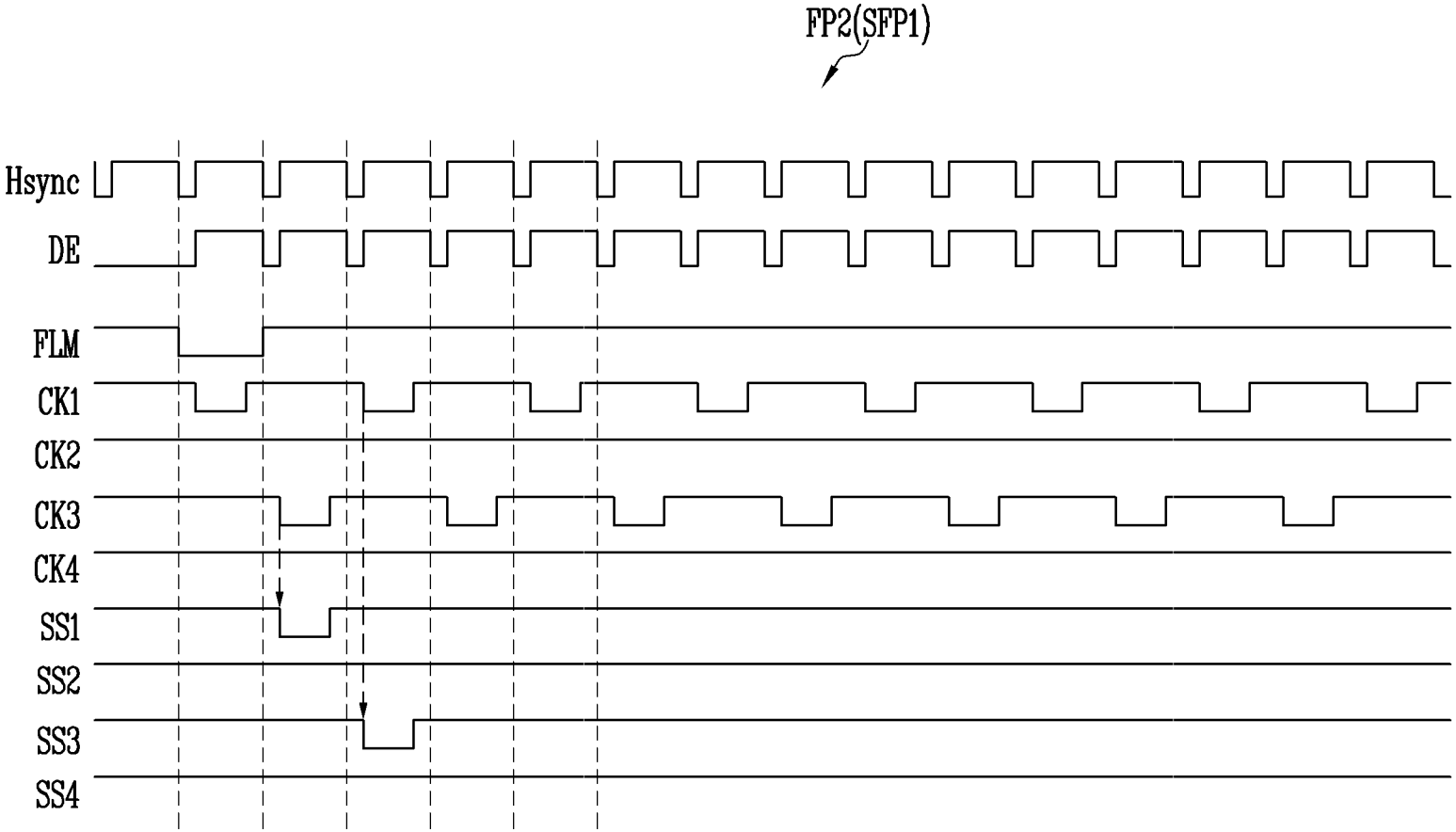

Referring to FIG. 9, control signals in the first sub-frame period SFP1 during the second frame period FP2 are illustrated. Specifically, control signals in a period except a data blank period BPC during the first sub-frame period SFP1 are illustrated.

During the first sub-frame period SFP1, the timing controller 11 may apply the first and third clock signals CK1 and CK3 of the turn-on level to the first and third clock lines CKL1 and CKL3, and maintain the second and fourth clock signals CK2 and CK4 applied to the second and fourth clock lines CKL2 and CKL4 as the turn-off level. In this embodiment, a cycle in which the first and third clock signals CK1 and CK3 of the turn-on level are applied to the first and third clock lines CKL1 and CLK3 in the first sub-frame period SFP1 may be shorter than that in which the first and third clock signals CK1 and CK3 of the turn-on level are applied to the first and third clock lines CKL1 and CLK3 in the first frame period FP1. For example, the cycle of each of the first and third clock signals CK1 and CK3 of the turn-on level may have two horizontal periods.

The timing controller 11 may apply the scan start signal FLM of the turn-on level to the scan start line FLML. The scan start signal FLM of the turn-on level may be set to overlap with the first clock signal CK of the turn-on level. For example, the length of the scan start signal FLM of the turn-on level may cover one horizontal period.

During the first sub-frame period SFP1, the scan driver 13 may apply the first and third scan signals SS1 and SS3 of the turn-on level to the first and third scan lines SL1 and SL3, and maintain the second and fourth scan signals SS2 and SS4 applied to the second and fourth scan lines SL2 and SL4 as the turn-off level. A cycle in which the first and third scan signals SS1 and SS3 of the turn-on level are applied to the first and third scan lines SL1 and SL3 in the first sub-frame period SFP1 may be shorter than that in which the first and third scan signals SS1 and SS3 of the turn-on level are applied to the first and third scan lines SL1 and SL3 in the first frame period FP1.

The data driver 12 may supply data voltages to the data lines in synchronization with the first and third scan signals SS1 and SS3 of the turn-on level.

Figure 10:
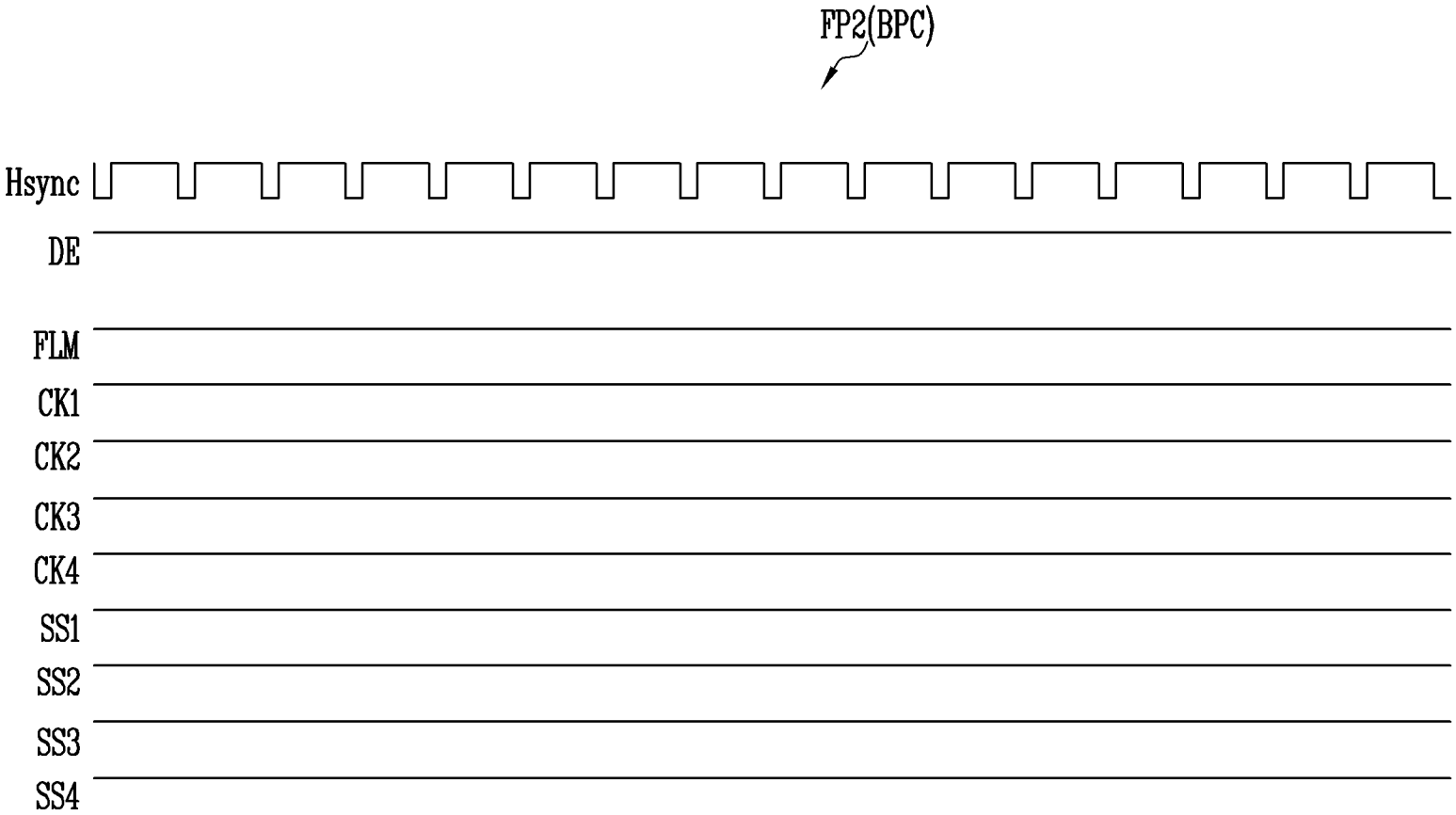

Referring to FIG. 10, control signals in a data blank period BPC during the second frame period FP2 are illustrated. In the data blank period BPC, the clock signals CK1, CK2, CK3, and CK4 of the turn-off level, the scan signals SS1, SS2, SS3, and SS4 of the turn-off level, and the scan start signal FLM of the turn-off level may be maintained.

During the data blank period BPC, the whole or at least a portion (gamma amp, digital logic) of the data driver 12 is power off, and therefore, power consumption may be decreased.

Figure 11:
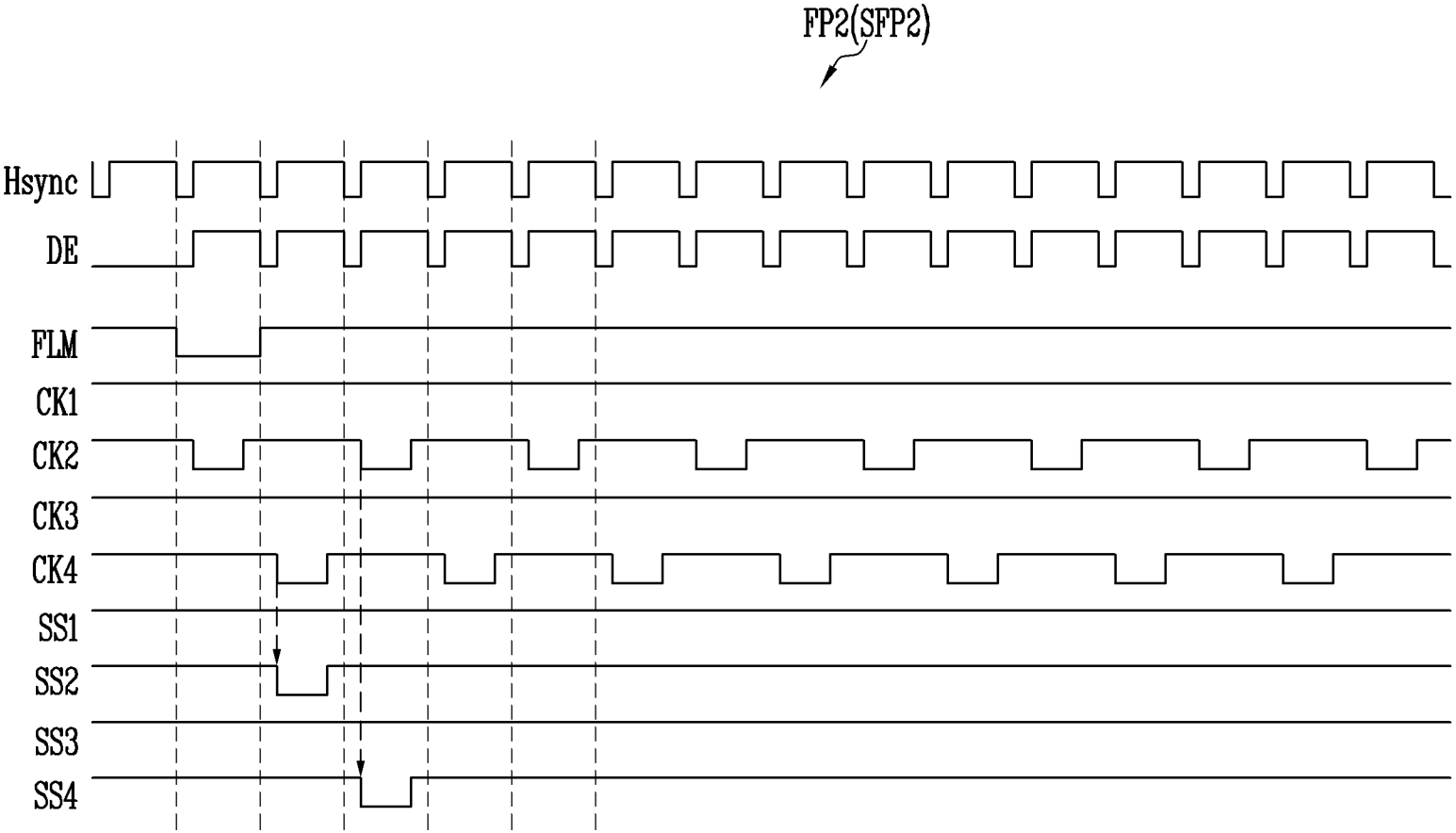

Referring to FIG. 11, control signals in the second sub-frame period SFP2 during the second frame period FP2 are illustrated. Specifically, FIG. 11 illustrates control signals in a period except the data blank period BPC during the second sub-frame period SFP2.

During the second sub-frame period SFP2, the timing controller 11 may apply the second and fourth clock signals CK2 and CK4 of the turn-on level to the second and fourth clock lines CKL2 and CKL4, and maintain the first and third clock signals CK1 and CK3 applied to the first and third clock lines CKL1 and CLK3 as the turn-off level. A cycle in which the second and fourth clock signals CK2 and CK4 of the turn-on level are applied to the second and fourth clock lines CKL2 and CKL4 in the second sub-frame period SFP2 may be shorter than that in which the second and fourth clock signals CK2 and CK4 of the turn-on level are applied to the second and fourth clock lines CKL2 and CKL4 in the first frame period FP1. For example, the cycle of each of the second and fourth clock signals CK2 and CK4 of the turn-on level may have two horizontal periods.

Also, the timing controller 11 may apply the scan start signal FLM of the turn-on level to the scan start line FLML. The scan start signal FLM of the turn-on level may be set to overlap with the second clock signal CK2 of the turn-on level. For example, the length of the scan start signal FLM of the turn-on level may cover one horizontal period.

During the second sub-frame period SFP2, the scan driver 13 may apply the second and fourth scan signals SS2 and SS4 of the turn-on level to the second and fourth scan lines SL2 and SL4, and maintain the first and third scan signals SS1 and SS3 applied to the first and third scan lines SL1 and SL3 as the turn-off level. A cycle in which the second and fourth scan signals SS2 and SS4 of the turn-on level is applied to the second and fourth scan lines SL2 and SL4 in the second sub-frame period SFP2 may be shorter than that in which the second and fourth scan signals SS2 and SS4 of the turn-on level is applied to the second and fourth scan lines SL2 and SL4 in the first frame period FP1.

The data driver 12 may supply data voltages to the data lines in synchronization with the second and fourth scan signals SS2 and SS4 of the turn-on level.

The data blank period BPC may be a remaining period after the data driver 12 ends the supply of data voltages in each of the first sub-frame period SFP1 and the second sub-frame period SFP2. During the data blank period BPC, the whole or at least a portion (gamma amp, digital logic) of the data driver 12 is power off, and therefore, power consumption may be decreased.

Figure 12:
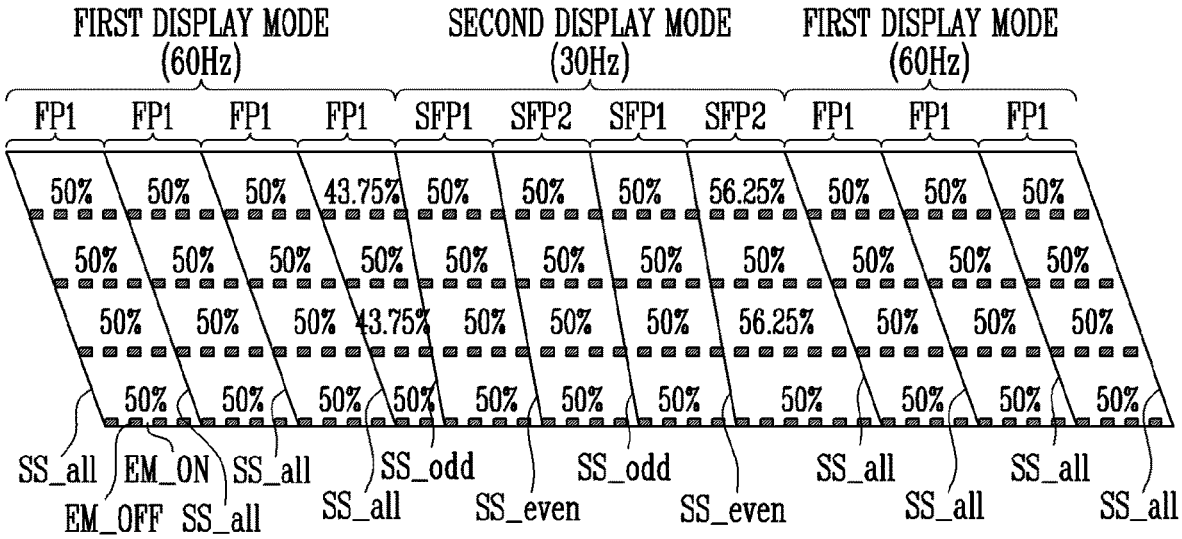

Referring to FIG. 12, as described above in FIG. 2B, in the display device 10 in accordance with the embodiment of the present disclosure, the off-duty number (or cycle number) of the emission control signal may be about 4 (or the off-duty number when the display device 10 is driven in the first display mode is 4 and the off-duty number when the display device 10 is driving in the second display mode is 8). That is, the number of pulses of the emission control signal in each of the first frame period FP1, the first sub-frame period SFP1, and the second sub-frame period SFP2 may be 4, except a time at which the mode of the display device 10 is changed from the first display mode (e.g., 60 Hz) to the second display mode (e.g., 30 Hz) or a time at which the mode of the display device 10 is changed from the second display mode to the first display mode. For convenience of description, in FIG. 12, an off period EM_OFF of the emission control signal indicated by a black square, and an on period EM_ON of the emission control signal is indicated by a blank area.

In the first display mode, scan signals (e.g., the first to fourth scan signals SS1 to SS4, see FIG. 8) supplied to all the scan lines SL1, SL2, SL3, . . . , SLm (see FIG. 1) may be sequentially supplied during the first frame period FP1. For convenience of description, in FIG. 12, this is indicated by a first oblique line SS_all.

During a period between first oblique lines SS_all, the plurality of pixels 14 (see FIG. 1) may emit no light in the off period EM_OFF of the emission control signal EM11, and emit light in the on period EM_ON of the emission control signal EM11. Thus, when the interval between the first oblique lines SS_all is constant in the first display mode, the emission time of the plurality of pixels 14 is also constant. Accordingly, a flicker phenomenon is not viewed by a user of the display device 10.

In the second display mode, scan signals (e.g., the first and third scan signals SS1 and SS3, see FIG. 9) supplied to the odd-numbered scan lines SL1, SL3, . . . , SLm−1 (see FIG.

1) may be sequentially supplied during the first sub-frame period SFP1. For convenience of description, in FIG. 12, this is indicated by a second oblique line SS_odd. Similarly, scan signals (e.g., the second scan signal SS2 and the fourth scan signal SS4, see FIG. 11) supplied to the even-numbered scan lines SL2, SL4, . . . , SLm (see FIG. 1) may be sequentially supplied during the second sub-frame period SFP2. For convenience of description, in FIG. 12, this is indicated by a third oblique line SS_even. As described above with reference to FIGS. 8 to 11, a total time required to supply odd-numbered scan signals during the first sub-frame period SFP1 and a total time required to supply even-numbered scan signals during the second sub-frame period SFP2 may be half of that required to supply all scan signals in the first frame period FP1. In other words, slopes of the second and third oblique lines SS_odd and SS_even may be twice greater than that of the first oblique line SS_all.

During a period between the second oblique line SS_odd and the third oblique line SS_even, the plurality of pixels 14 (see FIG. 1) may emit no light in the off period EM_OFF of the emission control signal EM11, and emit light in the on period EM_ON of the emission control signal EM11. Thus, when the interval between the second oblique line SS_odd and the third oblique line SS_even is constant in the second display mode, the emission time of the plurality of pixels 14 is also constant. Accordingly, a flicker phenomenon is not viewed by a user of the display device 10.

On the other hand, a boundary at which the mode of the display device 10 is changed from the first display mode to the second display mode will be described. Since the slopes of the first oblique line SS_all and the second oblique line SS_odd are different from each other, the interval between the first oblique line SS_all and the second oblique line SS_odd may not be constant. For example, the interval between the first oblique line SS_all and the second oblique line SS_odd may decrease as approaching an mth scan line SLm from the first scan line SL1 shown in FIG. 1. Therefore, the ratio of the off period to the frame period (FP1, SFP1 or SFP2) of the emission control signal may be changed according to positions of the plurality of pixels 14. For example, the ratio of the off period to the frame period (FP1, SFP1 or SFP2) of the emission control signal may be about 43.75% at a 1/4 spot and a 3/4 spot in one direction (e.g., a longitudinal direction) of the plurality of pixels 14. The ratio of the off period to the frame period (FP1, SFP1 or SFP2) of the emission control signal may be about 50% at a 2/4 spot and a 4/4 spot. Therefore, since the emission period is changed according to positions of the plurality of pixels 14, the flicker phenomenon may be viewed by the user of the display device 10.

In addition, a boundary at which the mode of the display device 10 is changed from the second display mode to the first display mode will be described. Since the slopes of the first oblique line SS_all and the third oblique line SS_even are different from each other, the interval between the first oblique line SS_all and the third oblique line SS_even may not be constant. For example, the interval between the first oblique line SS_all and the third oblique line SS_even may increase as approaching the mth scan line SLm from the first scan line SL1 shown in FIG. 1. Therefore, the ratio of the off period to the frame period (FP1, SFP1 or SFP2) of the emission control signal may be changed according to positions of the plurality of pixels 14. For example, the ratio of the off period to the frame period (FP1, SFP1 or SFP2) of the emission control signal may be about 56.25% at the 1/4 spot and the 3/4 spot in the one direction (e.g., the longitudinal direction) of the plurality of pixels 14. The ratio of the off period to the frame period (FP1, SFP1 or SFP2) of the emission control signal may be about 50% at the 2/4 spot and the 4/4 spot. Therefore, since the emission period is changed according to positions of the plurality of pixels 14, the flicker phenomenon may be viewed by the user of the display device 10.

Hereinafter, a driving method of the display device, which is used to prevent the flicker phenomenon, will be described later with reference to FIGS. 13 to 16.

FIGS. 13 to 16 are diagrams illustrating a first frame period and a second frame period in accordance with an embodiment of the present disclosure. As shown in FIG. 2B, it is assumed that the off-duty number (or cycle number) of the emission control signal EM11 of the display device 10 is 4. That is, the number of pulses of the emission control signal EM11 which are included in one cycle (e.g., FP1, SFP1, and SFP2), is 4.

Figure 13:
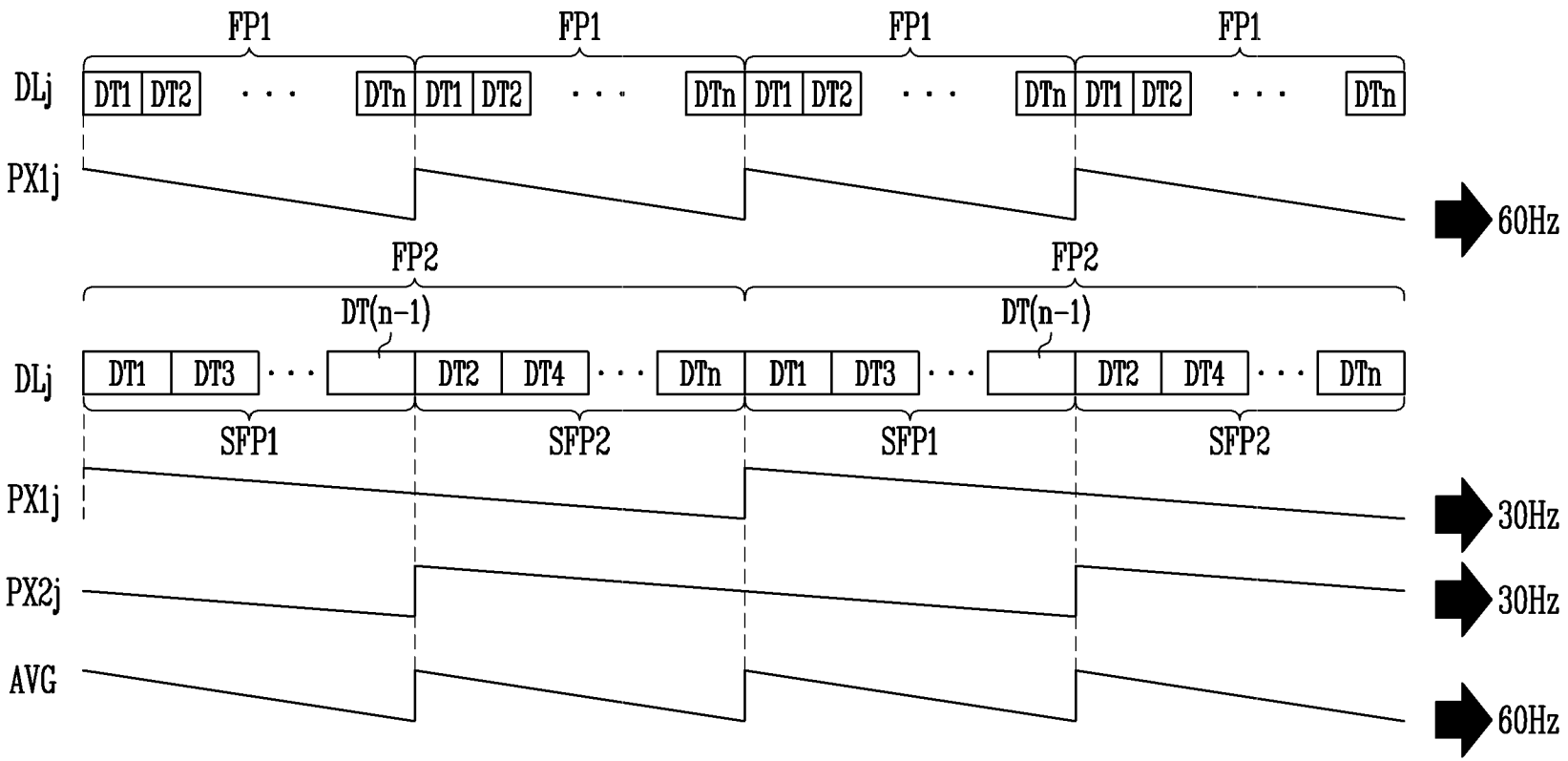
FIGS. 13, 14, 15 and 16 are diagrams illustrating a first frame period and a second frame period in accordance with an embodiment of the present disclosure.

In the embodiment shown in FIG. 13, a luminance waveform and a driving method of the first pixel PX1*j* in the first frame period FP1 is the same as those shown in FIG. 7. Also, in the embodiment shown in FIG. 13, individual luminance waveforms and an average luminance waveform AVG of the first and second pixels PX1*j* and PX2*j* in the second frame period FP2 are substantially the same as those shown in FIG. 7.

However, a driving method of the second frame period FP2 in the embodiment shown in FIG. 13 is different from the embodiment shown in FIG. 7, in that each of the first sub-frame period SFP1 and the second sub-frame period SFP2 does not include the data blank period BPC. For example, a length of each of the first sub-frame period SFP1 and the second sub-frame period SFP2, which are shown in FIG. 13, may be equal to that of each of the first sub-frame period SFP1 and the second sub-frame period SFP2, which are shown in FIG. 7. In the embodiment shown in FIG. 13, the data driver 12 may supply data voltages in a period equal to that shown in FIG. 7.

Figure 14:
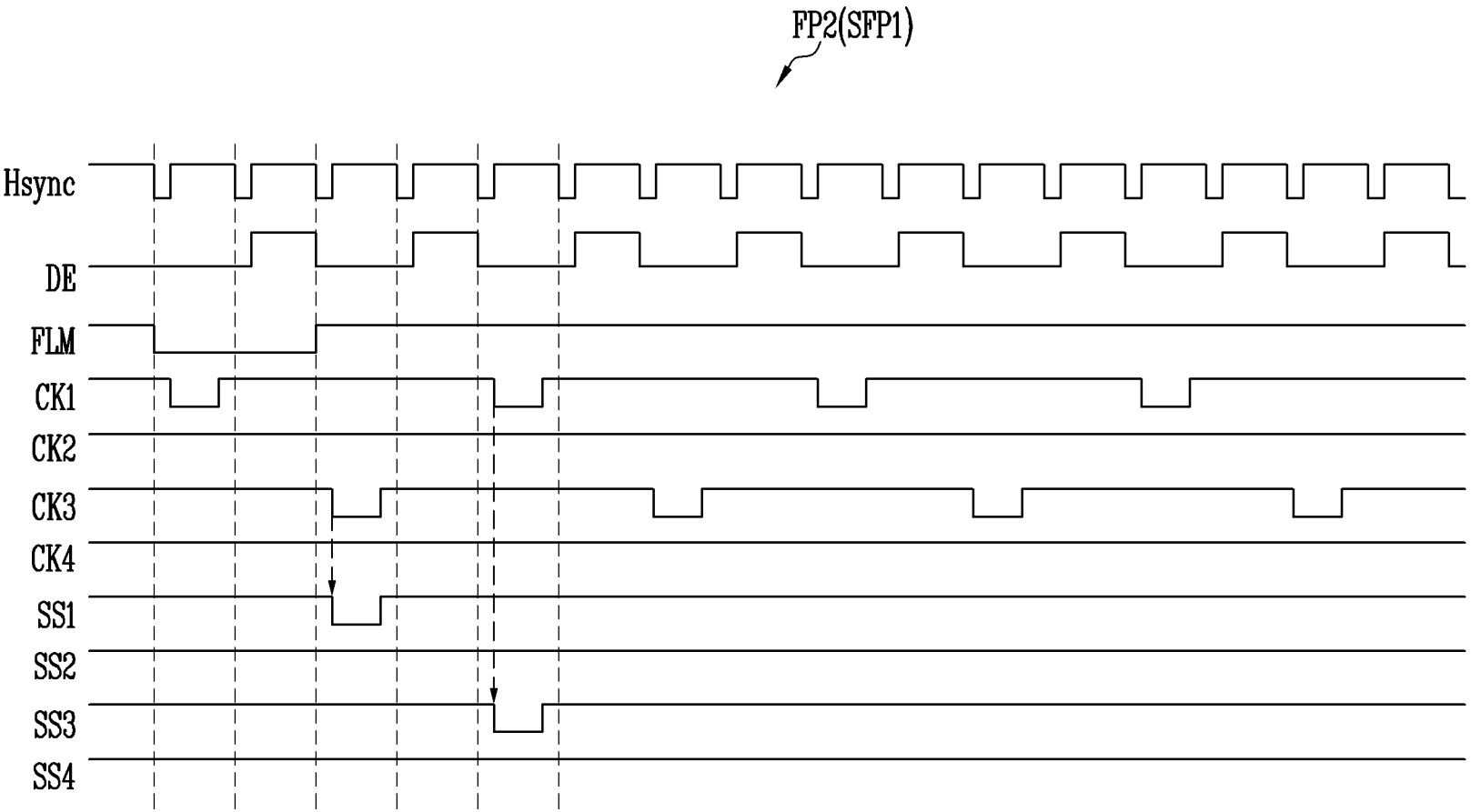

Referring to FIG. 14, control signals in the first sub-frame period SFP1 during the second frame period FP2 are illustrated.

During the first sub-frame period SFP1, the timing controller 11 may apply the first and third clock signals CK1 and CK3 of the turn-on level to the first and third clock lines CKL1 and CKL3, and maintain the second and fourth clock signals CK2 and CK4 applied to the second and fourth clock lines CKL2 and CKL4 as the turn-off level. In the first frame period FP1 and the first sub-frame period SFP1, cycles in which the first and third clock signals CK1 and CK3 of the turn-on level are applied to the first and third clock lines CLK1 and CLK3 may be the same. For example, the cycle of each of the first and third clocks CK1 and CK3 of the turn-on level may have four horizontal periods.

Also, the timing controller 11 may apply the scan start signal FLM of the turn-on level to the scan start line FLML. The length of the scan start signal FLM of the turn-on level may be set to overlap with the first clock signal CK1 of the turn-on level. For example, the scan start signal FLM of the turn-on level may cover two horizontal periods as shown in the drawing. However, the scan start signal FLM of the turn-on level may only cover one horizontal period.

During the first sub-frame period SFP1, the scan driver 13 may apply the first and third scan signals SS1 and SS3 of the turn-on level to the first and third scan lines SL1 and SL3, and maintain the second and fourth scan signals SS2 and SS4 applied to the second and fourth scan lines SL2 and SL4 as the turn-off level. In the first frame period FP1 and the first sub-frame period SFP1, cycles in which the first and third scan signals SS1 and SS3 of the turn-on level are applied to the first and third scan lines SL1 and SL3 may be the same.

The data driver 12 may supply data voltages to the first scan line SL1 and the third scan line SK3 in synchronization with the first and third scan signals SS1 and SS3 of the turn-on level. Since it is unnecessary to supply data voltages in synchronization with the second and fourth scan signals SS2 and SS4, a cycle of the data enable signal DE of the turn-on level in the first sub-frame period SFP1 may be set to be longer than that of the data enable signal DE of the turn-on level in the first frame period FP1. Accordingly, since the cycle in which the data driver 12 changes data voltages increases, the dynamic power required by the data driver 12 can decrease.

Figure 15:
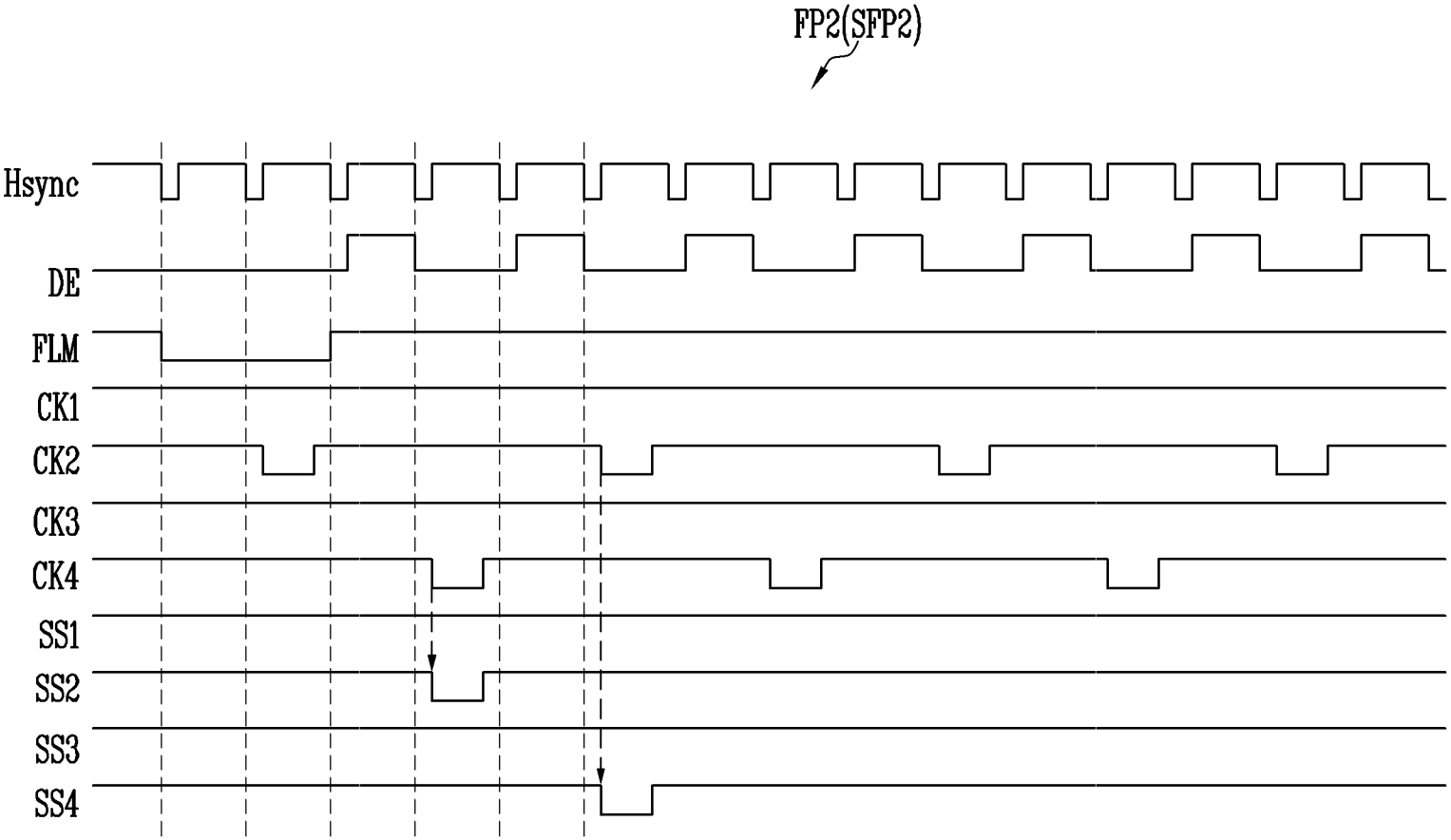

Referring to FIG. 15, control signals in the second sub-frame period SFP2 during the second frame period FP2 are illustrated.

During the second sub-frame period SFP2, the timing controller 11 may apply the second and fourth clock signals CK2 and CK2 of the turn-on level to the second and fourth clock lines CKL2 and CKL4, and maintain the first and third clock signals CK1 and CK3 applied to the first and third clock lines CKL1 and CKL3 as the turn-off level. In the first frame period FP1 and the second sub-frame period SFP2, cycles in which the second and fourth clock signals CK2 and CK4 of the turn-on level are applied to the second and fourth clock lines CKL2 and CKL4 may be the same. For example, the cycle of each of the second and fourth clock signals CK2 and CK4 of the turn-on level may have four horizontal periods.

Also, the timing controller 11 may apply the scan start signal FLM of the turn-on level to the scan start line FLML. The scan start signal FLM of the turn-on level may be set to overlap with the second clock signal CK2 of the turn-on level. For example, the scan start signal FLM of the turn-on level may have two horizontal periods as shown in the drawing. However. the scan start signal FLM of the turn-on level may only cover one horizontal period.

During the second sub-frame period SFP2, the scan driver 13 may apply the second and fourth scan signals SS2 and SS4 of the turn-on level to the second and fourth scan lines SL2 and SL4, and maintain the first and third scan signals SS1 and SS3 supplied to the first and third scan lines SL1 and SL3 as the turn-off level. In the first frame period FP1 and the second sub-frame period SFP2, cycles in which the second and fourth scan signals SS2 and SS4 of the turn-on level are applied to the second and fourth scan lines SL2 and SL4 may be the same.

The data driver 12 may supply data voltages in synchronization with the second and fourth scan signals SS2 and SS4 of the turn-on level. Since it is unnecessary to supply data voltages in synchronization with the first and third scan signals SS1 and SS3, a time of the data enable signal DE of the turn-on level in the second sub-frame period SFP2 may be longer than that of the data enable signal DE of the turn-on level in the first frame period FP1. Accordingly, since the time in which the data driver 12 supplies data voltages increases, the dynamic power required by the data driver 12 can decrease.

Figure 16:
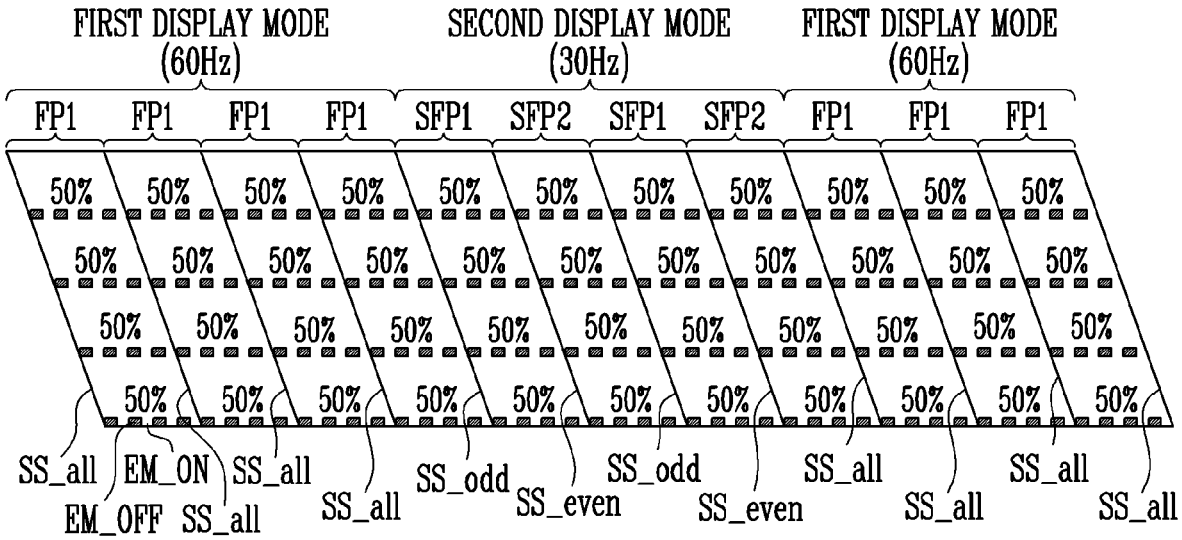

Referring to FIG. 16, as described above in FIG. 2B, in the display device 10 in accordance with the embodiment of the present disclosure, the off-duty number (or cycle number) of the emission control signal may be 4. That is, the number of pulses of the emission control signal in each of the first frame period FP1 of the first display mode (e.g., 60 Hz), and the first sub-frame period SFP1 and the second sub-frame period SFP2 of the second display mode (e.g., 30 Hz) may be 4. For convenience of description, in FIG. 16, an off period EM_OFF of the emission control signal indicated by a black square, and an on period EM_ON of the emission control signal is indicated by a blank area.

In the first display mode, scan signals (e.g., the first to fourth scan signals SS1 to SS4, see FIG. 8) supplied to all the scan lines SL1, SL2, SL3, . . . , SLm (see FIG. 1) may be sequentially supplied during the first frame period FP1. For convenience of description, in FIG. 16, this is indicated by a first oblique line SS_all.

During a period between first oblique lines SS_all, the plurality of pixels 14 (see FIG. 1) may emit no light in the off period EM_OFF of the emission control signal EM11 and emit light in the on period EM_ON of the emission control signal EM11. Thus, when the interval between the first oblique lines SS_all is constant in the first display mode, the emission time of the plurality of pixels 14 is also constant. Accordingly, a flicker phenomenon is not viewed by a user of the display device 10.

In the second display mode, scan signals (e.g., the first and third scan signals SS1 to SS3, see FIG. 9) supplied to the odd-numbered scan lines SL1, SL3, . . . , SLm−1 (see FIG. 1) may be sequentially supplied during the first sub-frame period SFP1. For convenience of description, in FIG. 16, this is indicated by a second oblique line SS_odd. Similarly, scan signals (e.g., the second scan signal SS2 and the fourth scan signal SS4, see FIG. 11) supplied to the even-numbered scan lines SL2, SL4, . . . , SLm (see FIG. 1) may be sequentially supplied during the second sub-frame period SFP2. For convenience of description, in FIG. 16, this is indicated by a third oblique line SS_even. As described above with reference to FIGS. 8, 14, and 15, a total time required to supply odd-numbered scan signals during the first sub-frame period SFP1 and a total time required to supply even-numbered scan signals during the second sub-frame period SFP2 may be equal to that required to supply all scan signals in the first frame period FP1. In other words, slopes of the second and third oblique lines SS_odd and SS_even may be equal to that of the first oblique line SS_all.

During a period between the second oblique line SS_odd and the third oblique line SS_even, the plurality of pixels 14 (see FIG. 1) may emit no light in the off period EM_OFF of the emission control signal EM11 and emit light in the on period EM_ON of the emission control signal EM11. Thus, when the interval between the second oblique line SS_odd and the third oblique line SS_even is constant in the second display mode, the emission time of the plurality of pixels 14 is also constant. Accordingly, a flicker phenomenon is not viewed by a user of the display device 10.

Meanwhile, unlike the embodiment shown in FIGS. 7 to 12, in the embodiment shown in FIGS. 13 to 16, a boundary time at which the mode of the display device 10 is changed from the first display mode to the second display mode will be described. Since the slopes of the first oblique line SS_all and the second oblique line SS_odd are the same, the interval between the first oblique line SS_all and the second oblique line SS_odd may be constantly maintained. Therefore, the ratio of the off period to frame period (FP1, SFP1 or SFP2) of the emission control signal may be the same in each position of the plurality of pixels 14. For example, the ratio of the off period to the frame period (FP1, SFP1 or SFP2) of the emission control signal may be about 50% at all spots of the plurality of pixels 14. Consequently, the emission period is the same in each position of the plurality of pixels 14, and accordingly, a flicker phenomenon is not viewed by a user of the display device 10.

Similarly, a boundary time at which the mode of the display device 10 is changed from the second display mode to the first mode will be described. Since the slopes of the first oblique line SS_all and the third oblique line SS_even are the same, the interval between the first oblique line SS_all and the third oblique line SS_even may be constantly maintained. Therefore, the ratio of the off period to frame period (FP1, SFP1 or SFP2) of the emission control signal may be the same in each position of the plurality of pixels 14. For example, the ratio of the off period to frame period (FP1, SFP1 or SFP2) of the emission control signal may be about 50% at all spots of the plurality of pixels 14. Consequently, the emission period is the same in each position of the plurality of pixels 14, and accordingly, a flicker phenomenon is not viewed by a user of the display device 10.

Hereinafter, other embodiments will be described. In the following embodiments, descriptions of components identical to those of the above-described embodiment will be omitted and simplified, and portions different from those of the above-described embodiment will be mainly described.

Figure 17A:
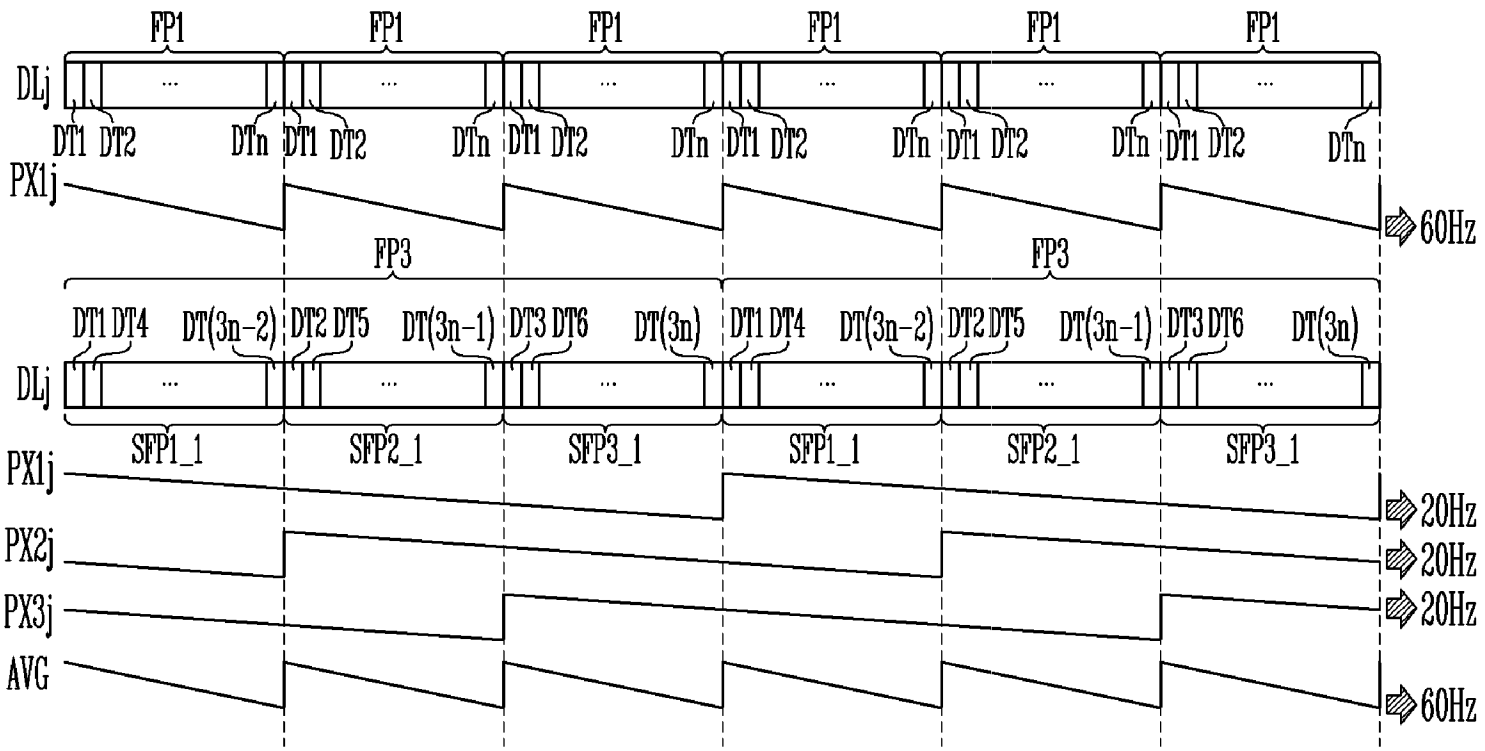
FIGS. 17A and 17B are diagram illustrating a first frame period and a third frame period in accordance with another embodiment of the present disclosure.
Figure 17B:
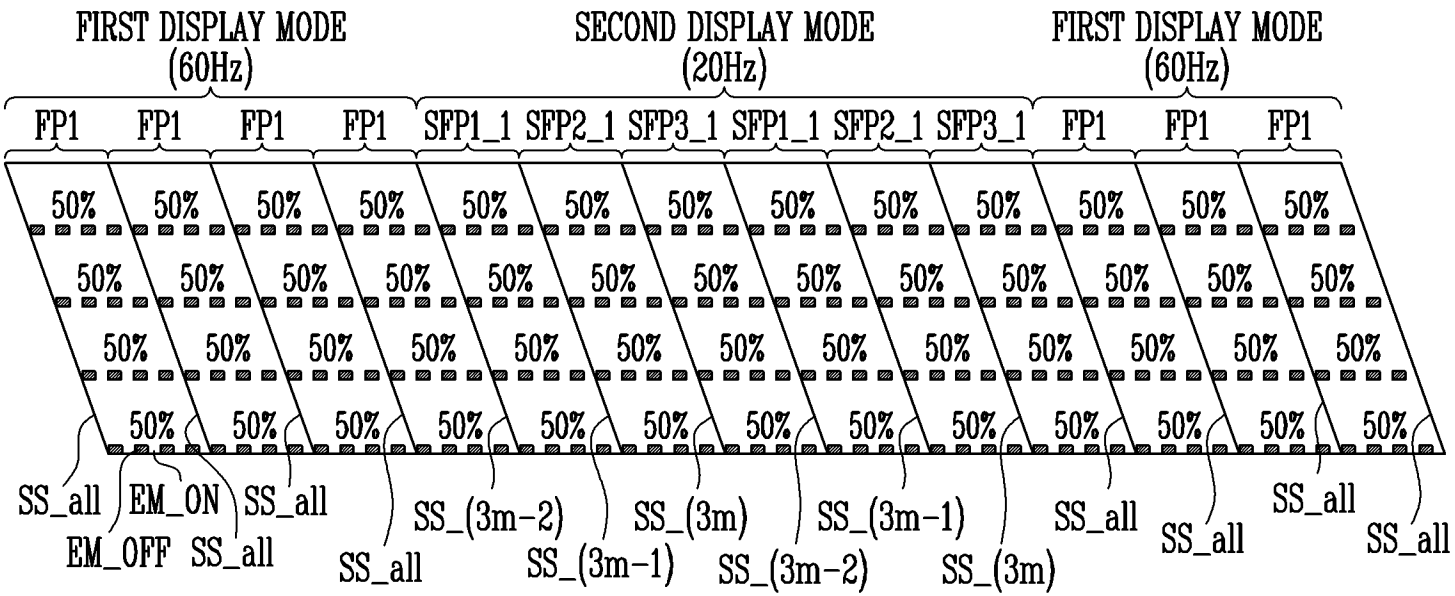

FIGS. 17A and 17B are diagram illustrating a first frame period and a third frame period in accordance with another embodiment of the present disclosure. As described above in FIG. 2B, it is assumed that the off-duty number (or cycle number) of the emission control signal in the display device 10 is 4. That is, the number of pulses of the emission control signal which are included in one cycle (e.g., FP1, SFP1_1, SFP2_1, and SFP3_1) is 4 (or the off-duty number included in a first frame period FP1 is 4 and the off-duty number included in a third frame period FP3 is 12). However, the off-duty ratio (or cycle number) of the emission control signal is merely illustrative, and the present disclosure is not limited thereto.

The embodiment shown in FIG. 17A, in which a carry level is 3, is different from the embodiment shown in FIG. 13, in which the carry level is 2. The interval (or unit) between stages to which a carry signal is transferred may be designated as a carry level. Although not shown in the drawing, the scan driver 13 (see FIG. 1) may include six clock signal lines and the cycle of the clock signals may have six horizontal periods. For example, referring to FIG. 4, when the first input terminal 1001 of the fourth stage ST4 receives a carry signal transferred from the output terminal 1004 of the first stage ST1, the carry level is 3.

Meanwhile, in FIG. 17A, a luminance waveform and a driving method of the first pixel PX1*j* in the first frame period FP1 is the same as those shown in FIG. 7. In addition, a driving method of the third frame period FP3 in the embodiment shown in FIG. 17A is substantially identical to that of the second frame period FP2 in the embodiment shown in FIG. 13, in that each of a (1_1)th sub-frame period SFP1_1, a (2_1)th sub-frame period SFP2_1, and a (3_1)th sub-frame SFP3_1 of the third frame period FP3 does not includes the data blank period BPC. Specifically, a cycle of clock signals of the (1_1)th, (2_1)th, and (3_1)th sub-frame periods SFP1_1, SFP2_1, and SFP3_1 may be maintained identically to that of clock signals of the first frame period FP1. For example, the cycle of the clock signals may have six horizontal periods in the first frame period FP1 and the third frame period FP3.

Each third frame period FP3 may include a (1_1)th sub-frame period SFP1_1, a (2_1)th sub-frame period SFP2_1, and a (3_1)th sub-frame period SFP3_1. Lengths of the (1_1)th sub-frame period SFP1_1, the (2_1)th sub-frame period SFP2_1, and the (3_1)th sub-frame period SFP3_1 may be equal to one another. For example, when assuming that the third frame period FP3 is 1/20 second, each of the (1_1)th sub-frame period SFP1_1, the (2_1)th sub-frame period SFP2_1, and the (3_1)th sub-frame period SFP3_1 may be 1/60 second.

In each (1_1)th sub-frame period SFP1_1, the data driver 12 may sequentially apply data voltages corresponding to a (3k−2)th pixel row (k is an integer greater than 0) to the data lines. For example, the data driver 12 may sequentially apply data voltages DT1, DT4, . . . , and DT(3n−2) to the jth data line DLj. Also, in each (2_1)th sub-frame period SFP2_1, the data driver 12 may sequentially apply data voltages corresponding to a (3k−1)th pixel row to the data lines. For example, the data driver 12 may sequentially apply data voltages DT2, DT5, . . . , and DT(3n−1) to the jth data line DLj. Similarly, in each (3_1)th sub-frame period SFP3_1, the data driver 12 may sequentially apply data voltages corresponding to a 3kth pixel row to the data lines. For example, the data driver 12 may sequentially apply data voltages DT3, DT6, . . . , DT3*n* to the jth data line DLj.

Accordingly, the first data voltage DT1 may be supplied to the first pixel PX1*j* at 20 Hz. Therefore, the first pixel PX emits light with a highest luminance at a time at which the first data voltage DT1 is to be applied and then the luminance may gradually decrease due to a leakage current. Referring to FIG. 17A, a luminance waveform of the first pixel PX1*j*, which correspond to the plurality of third frame periods FP3, is illustrated. The second data voltage DT2 may be applied to the second pixel PX2*j* at 20 Hz. Therefore, the second pixel PX2*j* emits light with a highest luminance at a time at which the second data voltage DT2 is to be applied, and then the luminance may gradually decrease due to a leakage current. Referring to FIG. 17A, a luminance waveform of the second pixel PX2*j*, which corresponds to the plurality of third frame periods FP3, is illustrated. A third data voltage DT3 may be applied to a third pixel PX3*j* at 20 Hz. Therefore, the third pixel PX3*j* emits light with a highest luminance at a time at which the third data voltage DT3 is to be applied, and then the luminance may gradually decrease due to a leakage current. Referring to FIG. 17A, a luminance waveform of the third pixel PX3*j*, which corresponds to the plurality of third frame periods FP3, is illustrated.

The first pixel PX1*j*, the second pixel PX2*j*, and the third pixel PX3*j* are located adjacent to each other, and therefore, the first data voltage DT1, the second data voltage DT2, and the third data voltage DT3 in a normal input image may be generally equal or similar to one another.

A time at which the first pixel PX1*j* has the highest luminance, a time at which the second pixel PX2*j* has the highest luminance, and a time at which the third pixel PX3*j* has the highest luminance are consecutively located, and are repeated for every frame. Therefore, a user may recognize the image as 60 Hz and average luminance waveform AVG of the first pixel PX1*j*, the second pixel PX2*j*, and the third pixel PX3*j* is recognize as a luminance. In this case, the user may recognizes images as if the images are displayed in 60 Hz even when the images are displayed in 20 Hz. Accordingly, when an image is displayed in the second display mode, the view of a flicker due to a difference in luminance waveform can be prevented while the display device 10 is driven at a frequency lower than that in the first display mode.

Moreover, referring to FIG. 17B, as described above in FIG. 2B, in the display device 10 in accordance with the embodiment of the present disclosure, the off-duty number (or cycle number) of the emission control signal may be 4. That is, the number of pulses of the emission control signal in each of the first frame period FP1 of the first display mode (e.g., 60 Hz), and the (1_1)th sub-frame period SFP1_1, the (2_1)th sub-frame period SFP2_1, and the (3_1)th sub-frame period SFP3_1 of the second display mode (e.g., 20 Hz) may be 4. For convenience of description, in FIG. 17B, an off period EM_OFF of the emission control signal indicated by a black square, and an on period EM_ON of the emission control signal is indicated by a blank area.

In the first display mode, scan signals (e.g., the first to fourth scan signals SS1 to SS4, see FIG. 8) supplied to all the scan lines SL1, SL2, SL3, . . . , SLm (see FIG. 1) may be sequentially supplied during the first frame period FP1. For convenience of description, in FIG. 17B, this is indicated by a first oblique line SS_all.

During a period between first oblique lines SS_all, the plurality of pixels 14 (see FIG. 1) may emit no light in the off period EM_OFF of the emission control signal EM11 and emit light in the on period EM_ON of the emission control signal EM11. Thus, when the interval between the first oblique lines SS_all is constant in the first display mode, the emission time of the plurality of pixels 14 is also constant. Accordingly, a flicker phenomenon is not viewed by a user of the display device 10.

In the second display mode, scan signals (e.g., the first scan signal SS1 and the fourth scan signal SS4) supplied to (3m−2)th scan lines SL1, SL4, . . . , and SL3*m*−2 (see FIG. 1) may be sequentially supplied during the (1_1)th sub-frame period SFP1_1. For convenience of description, in FIG. 17B, this is indicated by a (2_1)th oblique line SS_(3m−2). In addition, scan signals (e.g., the second scan signal SS2 and a fifth scan signal) supplied to (3m−1)th scan lines SL2, SL5, . . . , and SL3*m*−1 (see FIG. 1) may be sequentially supplied during the (2_1)th sub-frame period SFP2_1. For convenience of description, in FIG. 17B, this is indicated by a (3_1)th oblique line SS_(3m−1). Similarly, scan signals (e.g., the third scan signal SS3 and a sixth scan signal) supplied to 3mth scan lines SL3, SL6, . . . , and SL3*m* (see FIG. 1) may be sequentially supplied during the (3_1)th sub-frame period SFP3_1. For convenience of description, in FIG. 17B, this is indicated by a (4_1)th oblique line SS_(3m).

A total time required to supply the (3m−2)th scan signals during the (1_1)th sub-frame period SFP1_1, a total time required to supply the (3m−1)th scan signals during the (2_1)th sub-frame period SFP2_1, and a total time required to supply the 3mth scan signals during the (3_1)th sub-frame period SFP3_1 may be equal to that required to supply all the scan signals in the first frame period FP1. In other words, slopes of the (2_1)th, (3_1)th, and (4_1)th oblique lines SS_(3m−2), SS_(3m−1), and SS_(3m) may be equal to that of the first oblique line SS_all.

During periods between the (2_1)th oblique line SS_(3m−2), the (3_1)th oblique line SS_(3m−1), and the (4_1)th oblique line SS_(3m), the plurality of pixels 14 (see FIG. 1) may emit no light in the off period EM_OFF of the emission control signal EM11, and emit light in the on period EM_ON of the emission control signal EM11. Thus, when the interval between the (2_1)th oblique line SS_(3m−2), the (3_1)th oblique line SS_(3m−1), and the (4_1)th oblique line SS_(3m) is constant in the second display mode, the emission time of the plurality of pixels 14 is also constant. Accordingly, a flicker phenomenon is not viewed by a user of the display device 10.

Meanwhile, a boundary time at which the mode of the display device 10 is changed from the first display mode to the second display mode will be described. Since the slopes of the first oblique line SS_all and the (2_1)th oblique line SS_(3m−2) are the same, the interval between the first oblique line SS_all and the (2_1)th oblique line SS_(3m−2) may be constantly maintained. Therefore, the ratio of the off period to the frame period (FP1, SFP1, SFP2 or SFP3) of the emission control signal may be the same in each position of the plurality of pixels 14. For example, the ratio of the off period to the frame period (FP1, SFP1, SFP2 or SFP3) of the emission control signal may be about 50% at all spots of the plurality of pixels 14. Consequently, the emission period is the same in each position of the plurality of pixels 14, and accordingly, a flicker phenomenon is not viewed by a user of the display device 10.

Similarly, a boundary time at which the mode of the display device 10 is changed from the second display mode to the first mode will be described. Since the slopes of the first oblique line SS_all and the (4_1)th oblique line SS_(3m) are the same, the interval between the first oblique line SS_all and the (4_1)th oblique line SS_(3m) may be constantly maintained. Therefore, the ratio of the off period to the frame period (FP1, SFP1, SFP2 or SFP3) of the emission control signal may be the same in each position of the plurality of pixels 14. For example, the ratio of the off period to the frame period (FP1, SFP1, SFP2 or SFP3) of the emission control signal may be about 50% at all spots of the plurality of pixels 14. Consequently, the emission period is the same in each position of the plurality of pixels 14, and accordingly, a flicker phenomenon is not viewed by a user of the display device 10.

Figure 18A:
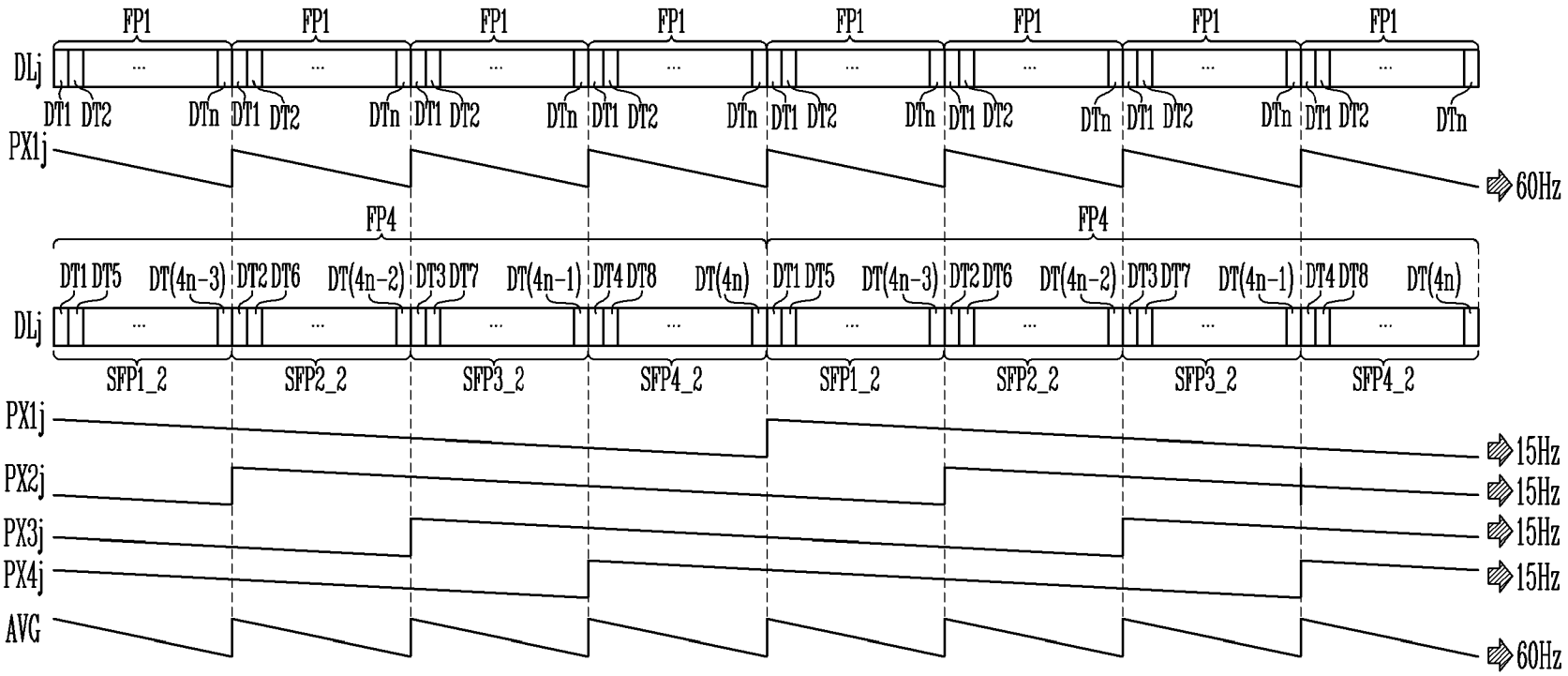
FIGS. 18A and 18B are diagram illustrating a first frame period and a fourth frame period in accordance with another embodiment of the present disclosure.
Figure 18B:
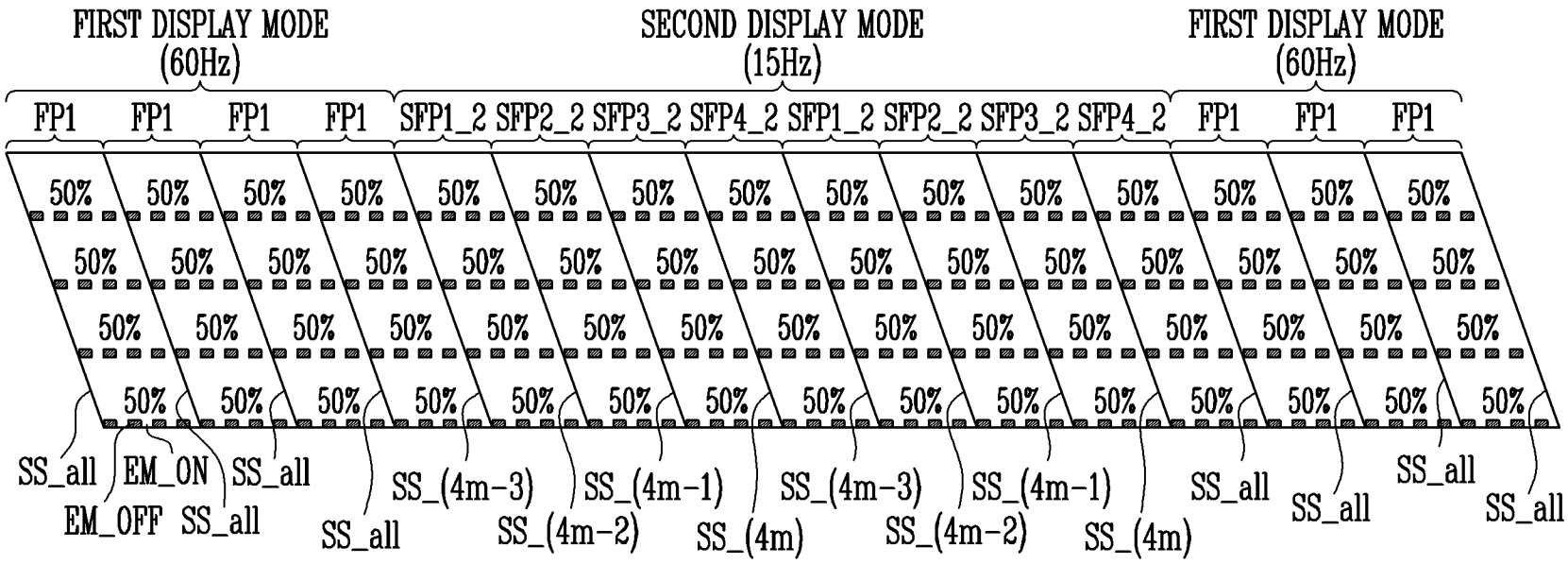

FIGS. 18A and 18B are diagram illustrating a first frame period and a fourth frame period in accordance with another embodiment of the present disclosure. As described above in FIG. 2B, it is assumed that the off-duty number (or cycle number) of the emission control signal in the display device 10 is 4 (or the off-duty number included in a first frame period FP1 is 4 and the off-duty number included in a fourth frame period FP4 is 16). That is, the number of pulses of the emission control signal, which are included in one cycle (e.g., FP1, SFP1_2, SFP2_2, SFP3_2, and SFP4_2) is 4. However, the off-duty ratio (or cycle number) of the emission control signal is merely illustrative, and the present disclosure is not limited thereto.

The embodiment shown in FIG. 18A, in which a carry level is 4, is different from the embodiment shown in FIG. 13, in which the carry level is 2. Although not shown in the drawing, the scan driver 13 (see FIG. 1) may include eight clock signal lines, the cycle of the clock signals may have eight horizontal periods. The interval (or unit) between stages to which a carry signal is transferred may be designated as a carry level. For example, when a first input terminal 1001 of a fifth stage ST5 receives a carry signal transferred from the output terminal 1004 of the first stage ST1, the carry level is 4.

Meanwhile, in FIG. 18A, a luminance waveform and a driving method of the first pixel PX1*j* in the first frame period FP1 is the same as those shown in FIG. 7. In addition, a driving method of the fourth frame period FP4 in the embodiment shown in FIG. 18A is substantially identical to that of the second frame period FP2 in the embodiment shown in FIG. 13, in that each of a (1_2)th sub-frame period SFP1_2, a (2_2)th sub-frame period SFP2_2, a (3_2)th sub-frame SFP3_2, and a (4_2)th sub-frame period SFP4_2 of the fourth frame period FP4 does not includes the data blank period BPC. Specifically, a cycle of clock signals of the (1_2)th, (2_2)th, (3_2)th and (4_2)th sub-frame periods SFP1_2, SFP2_2, SFP3_2, and SFP4_2 may be maintained identically to that of clock signals of the first frame period FP1. For example, the cycle of the clock signals may have eight horizontal periods in the first frame period FP1 and the second frame period FP2.

Each fourth frame period FP4 may include a (1_2)th sub-frame period SFP1_2, a (2_2)th sub-frame period SFP2_2, a (3_2)th sub-frame period SFP3_2, and a (4_2)th sub-frame period SFP4_2. Lengths of the (1_2)th sub-frame period SFP1_2, the (2_2)th sub-frame period SFP2_2, the (3_2)th sub-frame period SFP3_2, and the (4_2)th sub-frame period SFP4_2 may be equal to one another. For example, when assuming that the fourth frame period FP4 is 1/15 second, each of the (1_2)th sub-frame period SFP1_2, the (2_2)th sub-frame period SFP2_2, the (3_2)th sub-frame period SFP3_2, and the (4_2)th sub-frame period SFP4_2 may be 1/60 second.

In each (1_2)th sub-frame period SFP1_2, the data driver 12 may sequentially apply data voltages corresponding to a (4k−3)th pixel row (k is an integer greater than 0) to the data lines. For example, the data driver 12 may sequentially apply data voltages DT1, DT5, . . . , and DT(4n−3) to the jth data line DLj. Also, in each (2_2)th sub-frame period SFP2_2, the data driver 12 may sequentially apply data voltages corresponding to a (4k−2)th pixel row to the data lines. For example, the data driver 12 may sequentially apply data voltages DT2, DT6, . . . , and DT(4n−2) to the jth data line DLj. Also, in each (3_2)th sub-frame period SFP3_2, the data driver 12 may sequentially apply data voltages corresponding to a (4k−1)th pixel row to the data lines. For example, the data driver 12 may sequentially apply data voltages DT3, DT7, . . . , and DT(4n−1) to the jth data line DLj. Similarly, in each (4_2)th sub-frame period SFP3_1, the data driver 12 may sequentially apply data voltages corresponding to a 4kth pixel row to the data lines. For example, the data driver 12 may sequentially apply data voltages DT4, DT8, . . . , DT4*n* to the jth data line DLj.

Accordingly, the first data voltage DT1 may be supplied to the first pixel PX1*j* at 15 Hz. Therefore, the first pixel PX1*j* emits light with a highest luminance at a time at which the first data voltage DT1 is to be applied, and then the luminance may gradually decrease due to a leakage current. Referring to FIG. 18A, a luminance waveform of the first pixel PX1*j*, which correspond to the plurality of fourth frame periods FP4, is illustrated. Also, the second data voltage DT2 may be applied to the second pixel PX2*j* at 15 Hz. Therefore, the second pixel PX2*j* emits light with a highest luminance at a time at which the second data voltage DT2 is to be applied, and then the luminance may gradually decrease due to a leakage current. Referring to FIG. 18A, a luminance waveform of the second pixel PX2*j*, which corresponds to the plurality of fourth frame periods FP4, is illustrated. Also, the third data voltage DT3 may be applied to the third pixel PX3*j* at 15 Hz. Therefore, the third pixel PX3*j* emits light with a highest luminance at a time at which the third data voltage DT3 is to be applied, and then the luminance may gradually decrease due to a leakage current. Referring to FIG. 18A, a luminance waveform of the third pixel PX3*j*, which corresponds to the plurality of fourth frame periods FP4, is illustrated. Similarly, a fourth data voltage DT4 may be applied to a fourth pixel PX4*j* at 15 Hz. Therefore, the fourth pixel PX4*j* emits light with a highest luminance at a time at which the fourth data voltage DT4 is to be applied, and then the luminance may gradually decrease due to a leakage current. Referring to FIG. 18A, a luminance waveform of the fourth pixel PX4*j*, which corresponds to the plurality of fourth frame periods FP4, is illustrated.

The first pixel PX1*j*, the second pixel PX2*j*, the third pixel PX3*j*, and the fourth pixel PX4*j* are located adjacent to each other, and therefore, the first data voltage DT1, the second data voltage DT2, the third data voltage DT3, and the fourth data voltage DT4 in a normal input image may be generally equal or similar to one another.

A time at which the first pixel PX1*j* has the highest luminance, a time at which the second pixel PX2*j* has the highest luminance, a time at which the third pixel PX3*j* has the highest luminance, and a time at which the fourth pixel PX4*j* has the highest luminance are consecutively located, and are repeated for every frame. Therefore, a user may recognize the image as 60 Hz and an average luminance waveform AVG of the first pixel PX1*j*, the second pixel PX2*j*, the third pixel PX3*j*, and the fourth pixel PX4*j* is recognized as a luminance. In this case, the user may recognizes images as if the images are displayed in 60 Hz even when the images are displayed in 15 Hz. Accordingly, when an image is displayed in the second display mode, the view of a flicker due to a difference in luminance waveform can be prevented while the display device 10 is driven at a frequency lower than that in the first display mode.

Moreover, referring to FIG. 18B, as described above in FIG. 2B, in the display device 10 in accordance with the embodiment of the present disclosure, the off-duty number (or cycle number) of the emission control signal may be 4. That is, the number of pulses of the emission control signal in each of the first frame period FP1 of the first display mode (e.g., 60 Hz), and the (1_2)th sub-frame period SFP1_2, the (2_2)th sub-frame period SFP2_2, the (3_2)th sub-frame period SFP3_2, and the (4_2)th sub-frame period SFP4_2 of the second display mode (e.g., 15 Hz) may be 4. For convenience of description, in FIG. 18B, an off period EM_OFF of the emission control signal indicated by a black square and an on period EM_ON of the emission control signal is indicated by a blank area.

In the first display mode, scan signals (e.g., the first to fourth scan signals SS1 to SS4, see FIG. 8) supplied to all the scan lines SL1, SL2, SL3, . . . , SLm (see FIG. 1) may be sequentially supplied during the first frame period FP1. For convenience of description, in FIG. 19B, this is indicated by a first oblique line SS_all.

During a period between first oblique lines SS_all, the plurality of pixels 14 (see FIG. 1) may emit no light in the off period EM_OFF of the emission control signal EM11, and emit light in the on period EM_ON of the emission control signal EM11. Thus, when the interval between the first oblique lines SS_all is constant in the first display mode, the emission time of the plurality of pixels 14 is also constant. Accordingly, a flicker phenomenon is not viewed by a user of the display device 10.

In the second display mode, scan signals (e.g., the first scan signal SS1 and the fifth scan signal) supplied to (4m−3)th scan lines SL1, SL5, . . . , and SL4*m*−3 (see FIG. 1) may be sequentially supplied during the (1_2)th sub-frame period SFP1_2. For convenience of description, in FIG. 18B, this is indicated by a (2_2)th oblique line SS_(4m−3). In addition, scan signals (e.g., the second scan signal SS2 and the sixth scan signal) supplied to (4m−2)th scan lines SL2, SL6, . . . , and SL4*m*−2 (see FIG. 1) may be sequentially supplied during the (2_2)th sub-frame period SFP2_2. For convenience of description, in FIG. 18B, this is indicated by a (3_2)th oblique line SS_(4m−2). In addition, scan signals (e.g., the third scan signal SS3 and a seventh scan signal) supplied to (4m−1)th scan lines SL3, SL7, . . . , and SL4*m*−1 (see FIG. 1) may be sequentially supplied during the (3_2)th sub-frame period SFP3_2. For convenience of description, in FIG. 18B, this is indicated by a (4_2)th oblique line SS_(4m−1). Similarly, scan signals (e.g., the fourth scan signal SS4 and an eighth scan signal) supplied to 4mth scan lines SL4, SL8, . . . , and SL4*m* (see FIG. 1) may be sequentially supplied during the (4_2)th sub-frame period SFP4_2. For convenience of description, in FIG. 18B, this is indicated by a (5_2)th oblique line SS_(4m).

A total time required to supply the (4m−3)th scan signals during the (1_2)th sub-frame period SFP1_2, a total time required to supply the (4m−2)th scan signals during the (2_2)th sub-frame period SFP2_2, a total time required to supply the (4m−1)th scan signals during the (3_2)th sub-frame period SFP3_2, and a total time required to supply the 4mth scan signals during the (4_2)th sub-frame period SFP4_2 may be equal to that required to supply all the scan signals in the first frame period FP1. In other words, slopes of the (2_2)th, (3_2)th, (4_2)th, and (5_2)th oblique lines SS_(4m−3), SS_(4m−2), SS_(4m−1), and SS_(4m) may be equal to that of the first oblique line SS_all.

During periods between the (2_2)th oblique line SS_(4m−3), the (3_2)th oblique line SS_(4m−2), (4_2)th oblique line SS_(4m−1), and the (5_2)th oblique line SS_(4m), the plurality of pixels 14 (see FIG. 1) may emit no light in the off period EM_OFF of the emission control signal EM11, and emit light in the on period EM_ON of the emission control signal EM11. Thus, when the interval between the (2_2)th oblique line SS_(4m−3), the (3_2)th oblique line SS_(4m−2), (4_2)th oblique line SS_(4m−1), and the (5_2)th oblique line SS_(4m) is constant in the second display mode, the emission time of the plurality of pixels 14 is also constant. Accordingly, a flicker phenomenon is not viewed by a user of the display device 10.

Meanwhile, a boundary time at which the mode of the display device 10 is changed from the first display mode to the second display mode will be described. Since the slopes of the first oblique line SS_all and the (2_2)th oblique line SS_(4m−3) are the same, the interval between the first oblique line SS_all and the (2_2)th oblique line SS_(4m−3) may be constantly maintained. Therefore, the ratio of the off period to the frame period (FP1, SFP1, SFP2, SFP3 or SFP4) of the emission control signal may be the same in each position of the plurality of pixels 14. For example, the ratio of the off period to the frame period (FP1, SFP1, SFP2, SFP3 or SFP4) of the emission control signal may be about 50% at all spots of the plurality of pixels 14. Consequently, the emission period is the same in each position of the plurality of pixels 14, and accordingly, a flicker phenomenon is not viewed by a user of the display device 10.

Similarly, a boundary time at which the mode of the display device 10 is changed from the second display mode to the first mode will be described. Since the slopes of the first oblique line SS_all and the (5_2)th oblique line SS_(4m) are the same, the interval between the first oblique line SS_all and the (5_2)th oblique line SS_(4m) may be constantly maintained. Therefore, the ratio of the off period to the frame period (FP1, SFP1, SFP2, SFP3 or SFP4) of the emission control signal may be the same in each position of the plurality of pixels 14. For example, the ratio of the off period to the frame period (FP1, SFP1, SFP2, SFP3 or SFP4) of the emission control signal may be about 50% at all spots of the plurality of pixels 14. Consequently, the emission period is the same for each position of the plurality of pixels 14, and accordingly, a flicker phenomenon is not viewed by a user of the display device 10.

In the display device in accordance with the present disclosure, the waveform of a clock signal (or scan signal) provided to the scan driver is adjusted. Accordingly, a flicker phenomenon can be prevented, and a mode change between progressive scanning and interlaced scanning can be made.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A display device comprising:

a plurality of pixels;

an emission control driver configured to provide emission control signals to the plurality of pixels;

a scan driver configured to provide scan signals to a plurality of scan lines connected to the plurality of pixels; and a timing controller configured to select whether the display device is to operate in any one of a first display mode in which the display device is driven at a first frequency and a second display mode in which the display device is driven at a second frequency lower than the first frequency based on input image data, wherein the first display mode comprises a plurality of first frame periods and the second display mode comprises a plurality of second frame periods having at least two sub-frames having a period equal to the first frame period, and wherein each of a total time required to supply the scan signals to the plurality of scan lines in the first frame period, a total time required to supply the scan signals to odd-numbered scan lines of the plurality of scan lines in one sub frame period, and a total time required to supply the scan signals to even-numbered scan lines of the plurality of scan lines in another sub frame period is substantially same.

2. The display device of claim 1, wherein the timing controller receives the input image data, and outputs a clock signal, a scan start signal, and image data.

3. The display device of claim 2, wherein the scan driver comprises a plurality of stages connected to a plurality of clock signal lines to which the clock signal is provided, the plurality of stages generating scan signals in response to the scan start signal.

4. The display device of claim 2, wherein a carry signal is transferred to a stage after next, and wherein the second frame period comprises a first sub-frame period in which odd-numbered scan signals among the plurality of scan signals are provided to the plurality of pixels and a second sub-frame period in which even-numbered scan signals among the plurality of scan signals are provided to the plurality of pixels.

5. The display device of claim 4, wherein a cycle of a clock signal of the first frame period is equal to a cycle of a clock signal of the first sub-frame period and a cycle of a clock signal of the second sub-frame period.

6. The display device of claim 5, wherein the cycle of the clock signal of the first frame period, the cycle of the clock signal of the first sub-frame period, and the cycle of the clock signal of the second sub-frame period have four horizontal periods.

7. The display device of claim 4, wherein the clock signal lines comprises a first clock line, a second clock line, a third clock line, and a fourth clock line, and wherein the first clock line and the third clock line are alternately connected to first and second clock input terminals of odd-numbered stages among the stages, and the second clock line and the fourth clock line are alternately connected to first and second clock input terminals of even-numbered stages among the stages.

8. The display device of claim 7, wherein, during the first frame period, the timing controller sequentially supplies a first clock signal to the first clock line, a second clock signal to the second clock line, a third clock signal to the third clock line, and a fourth clock signal to the fourth clock line.

9. The display device of claim 8, wherein, during the first sub-frame period, the timing controller provides the first clock signal and the third clock signal of a turn-on level to the first clock line and the third clock line, and provides the second clock signal and the fourth clock signal of a turn-off level to the second clock line and the fourth clock line, respectively.

10. The display device of claim 8, wherein, during the second sub-frame period, the timing controller provides the first clock signal and the third clock signal of a turn-off level to the first clock line and the third clock line, and provides the second clock signal and the fourth clock signal of a turn-on level to the second clock line and the fourth clock line, respectively.

11. The display device of claim 2, further comprising a data driver configured to generate data signals based on the image data, wherein each of the plurality of pixels emits light with a luminance corresponding to a data signal in response to a scan signal of the plurality of scan signals.

12. The display device of claim 1, wherein the timing controller further comprises a luminance controller configured to adjust an off-duty number as a number of pulses of the emission control signal, which are comprised in a predetermined period.

13. The display device of claim 11, wherein the luminance controller sets the off-duty number of the emission control signal to be 4 during the first frame period of the first display mode and the sub-frame period of the second display mode.

14. The display device of claim 12, wherein a ratio of an off period to a frame period of the emission control signal is 50% in all areas of the plurality of pixels during the first frame period and the second frame period.

15. The display device of claim 1, wherein the timing controller:

selects the first display mode when grayscale values of the input image data, which correspond to each of consecutive frames, are substantially different from each other; and selects the second display mode when grayscale values of the input image data, which correspond to each of consecutive frames, are substantially the same.

* * * * *